US007740309B2

(12) United States Patent
Mayercheck

(10) Patent No.: US 7,740,309 B2
(45) Date of Patent: Jun. 22, 2010

(54) FOLDING CHAIR

(76) Inventor: Robert P. Mayercheck, 3 Sand, Irvine, CA (US) 92614

( * ) Notice: Subject to any disclaimer, the term of this patent is extended or adjusted under 35 U.S.C. 154(b) by 0 days.

(21) Appl. No.: 12/122,156

(22) Filed: May 16, 2008

(65) Prior Publication Data

US 2008/0284216 A1 Nov. 20, 2008

Related U.S. Application Data

(60) Provisional application No. 60/938,877, filed on May 18, 2007.

(51) Int. Cl.
*A47C 4/00* (2006.01)

(52) U.S. Cl. ..... 297/46; 297/16.1; 297/16.2; 297/17; 297/19; 297/48; 297/51; 297/52; 297/53; 297/54

(58) Field of Classification Search ..... 297/16.1, 297/16.2, 18, 19, 46, 48, 49, 51, 52, 54, 17, 297/53

See application file for complete search history.

(56) References Cited

U.S. PATENT DOCUMENTS

| | | | | | |
|---|---|---|---|---|---|
| 208,864 | A * | 10/1878 | Teal | 297/53 |
| 1,640,273 | A * | 8/1927 | Halais | 297/52 |
| 1,693,349 | A * | 11/1928 | Rastetter | 297/48 |
| 1,727,115 | A * | 9/1929 | Rastetter | 297/48 |
| 2,894,564 | A * | 7/1959 | Lorenz | 297/51 |
| 3,005,659 | A * | 10/1961 | Sanders | 297/19 |
| 4,671,570 | A | 6/1987 | Hockenberry et al. | |
| 5,395,154 | A * | 3/1995 | Wang | 297/17 X |
| 6,109,696 | A | 8/2000 | Newhouse et al. | |
| D467,089 | S | 12/2002 | Wu | |
| 6,698,828 | B1 * | 3/2004 | Chan | 297/54 |
| D493,293 | S * | 7/2004 | Vira | D6/349 |
| 6,871,906 | B2 | 3/2005 | Haney | |
| 6,877,804 | B2 * | 4/2005 | Chan | 297/54 |
| 6,899,384 | B1 * | 5/2005 | Tseng | 297/46 |
| D518,303 | S * | 4/2006 | Vira | D6/368 |
| 2003/0196356 | A1 | 10/2003 | Wu | |
| 2004/0251718 | A1 | 12/2004 | Degen et al. | |
| 2009/0250988 | A1 * | 10/2009 | Catanzarite et al. | 297/354.1 |

OTHER PUBLICATIONS

NeoCon 2003—Piretti Dance Chair; 3 pages.
Spin; Joseph Sean O'Brien; Sep./Oct. 2005; SDR 2005.
Lifetime Advantage Contoured Commercial Chairs; website: http://www.lifetime.com/catalog/default.asp?cat=3&brand=3&group=10&model=62; Dec. 12, 2002.

(Continued)

*Primary Examiner*—Rodney B White
(74) *Attorney, Agent, or Firm*—Knobbe, Martens, Olson & Bear, LLP

(57) ABSTRACT

A folding chair utilizes a gear train to control a folding motion and to achieve a compact closed form. While holding a handle integrated into a backrest, the weight of the chair allows it to open and unfold automatically into an open position. The folding chair locks in place in the open position. To refold the chair, a button is depressed to release the lock and the seat is pulled toward the backrest. The gear train refolds the front and rear legs. In the compact folded position, the lightweight chair can be carried with one hand in a relaxed position, similar to an attache case. The handle is contoured so that it is possible for an adult to carry two chairs back to back in each hand.

46 Claims, 25 Drawing Sheets

OTHER PUBLICATIONS

Lifetime Accent Comfort Style Chairs; website: http://www.lifetime.com/catalog/default.asp?cat=3&brand=2&group=22&model=47; Dec. 12, 2002.
SwiftSet Folding Chair; www.mitylite.com; Aug. 4, 2003; 1 page.
Viva; AmericanSeating; @2005; 1 page.
Rapid Technology Makes Gains; Waterman; Apr. 2007; 1 page.
Plia; Haworth; @2005; 1 page.
Mondial; Gerrit Rietveld; 2006; 2 pages.
Magellan's; Folding Travel Chair; 2003; 1 page.
Vox.01; hillcrossfurniture.co.uk; Jan. 21, 2003; 1 page.
Rondine Sedia; hillcrossfurniture.co.uk; Jan. 21, 2003; 1 page.
Flik; hillcrossfurniture.co.uk. Jan. 21, 2003; 1 page.
Santachair; hillcrossfurniture.co.uk; Jan. 21, 2003; 1 page.
Newport armchair; website: http://www.red-dot.de/home/page.php?bid=9&mid=803&uid=8012&cid=200&pid=2002; Oct. 28, 2002; 1 page.
Rex Armchair; 1 page, May 16, 2008.
Vela Folding Chair; designboom; www.italianclassicsdirect.com; 2 pages; May 16, 2008.
Uts (urban traveler seat); designboom; 2 pages; May 16, 2008.
Kappa ; designboom; 1 page; May 16, 2008.
Flip it ; designboom; 3 pages; May 16, 2008.
110 ; designboom; 1 page; May 16, 2008.
s-type ; designboom; 1 page; May 16, 2008.
Tattolay ; designboom; 3 pages; May 16, 2008.
Osso chair ; designboom; 3 pages; May 16, 2008.
Chai linea; designboom; 4 pages; May 16, 2008.
Pico; www.rei.com; 1 page; May 16, 2008.
OfficeMax Steel Folding/Stacking Chairs Ad; 1 page; May 16, 2008.

* cited by examiner

FOLDING CHAIR

CROSS-REFERENCE TO RELATED APPLICATIONS

This application claims the priority benefit under 35 U.S.C. §119(e) of U.S. Provisional Patent Application No. 60/938,877, filed on May 18, 2007, which is incorporated by reference in its entirety.

BACKGROUND OF THE INVENTION

1. Field of the Invention

The present invention generally relates to folding chairs and in particular to a chair that folds compactly in a controlled fashion.

2. Description of the Related Art

Chairs presently used in business environments for occasional use are available in several types of configurations. These configurations are chiefly known by the nature of how the chairs are efficiently stored when not in use.

In the past, one type of chair (type 1) could fold by having the front and rear legs compress together along with the seat. The back is formed as part of the front legs that extend upward. An example of this type of design is illustrated by a chair disclosed in U.S. Pat. No. 6,871,906 B2 to Haney. This type of chair is stored when folded in an upright position and stacked horizontally next to one another. Trollies exist to contain a number of this type of folding chair together and transport them to the place where needed.

Another occasional chair configuration (type 2) stacks vertically for storage. Each chair is designed such that the legs can fit over the seat so the chairs can stack over each other. Multiple stacks can be transported on trollies for set-up. An example of this type of chair is disclosed in U.S. Pat. No. 6,109,696 to Newhouse. The stacks vary in height and verticality depending on the design. Since Type 2 chairs do not compress they are often made to higher quality standards, are heavier in weight, and are used in a wider range of contract environments.

Type 1 and Type 2 chairs represent the majority of contract market occasional seating configurations. There are numerous designs available within each category. More recently, an alternate configuration (Type 3) was created in which the chairs have wheels and nest together horizontally for storage. This approach is commonly used in retail shopping carts typically found at grocery stores, etc. It is represented by the Dance chair by KI. These chairs are stored by wheeling them together in compact rows.

SUMMARY OF THE INVENTION

The chairs of Type 1, 2, and 3 can satisfy a wide range of business needs, but in certain environments, an appropriate solution is lacking. The folding chair invention disclosed herein was created to satisfy the need for an occasional chair to be used on an outdoor deck or terrace for business meetings and entertaining clients for coffee or drinks.

For this use, a lightweight chair that could be easily carried by each participant from an indoor office to the outside deck is desired. It also could be conveniently stored within the office and not in a central storage location, so that it can be readily used when desired. For client entertainment needs the chair preferably is special and comfortable and not left out in the elements.

Type 1 chairs are somewhat heavy and cumbersome to carry, especially with one hand. They are not typically used in a contract office setting and are not manufactured to contract quality standards. They are commonly used in training or conference settings and can be quite uncomfortable.

Type 2 and 3 chairs are comfortable, but rather heavy, and not conveniently stored and carried from an office to a deck, especially if it is up a short flight of stairs, or separated by door rails.

Other low cost plastic chairs are available and used and left outdoors, but they are not contract quality, must be cleaned often, and typically degrade in the elements. Better quality café and patio chairs cannot be left outside without security, as they are frequently stolen.

From the foregoing, it will be appreciated that there is a need for a lightweight, easily transported and stored, high-quality folding chair, suitable for business client entertainment.

The aforementioned needs are satisfied by various features, aspects and advantages of the present folding chair design. In some embodiments, the chair comprises sets of folding members (e.g., subassemblies) connected to the seat, which are attached to the seat, that control the position of the subassemblies. In some embodiments, the gearboxes each contain a gear train that attaches to the front leg, rear leg and back subassemblies. Thus, pivot motion of any of the back, front legs, or rear legs will effect the positions of the other subassemblies.

This interconnection of the front legs, rear legs, and back relative to the seat provides a convenient means of quickly folding and unfolding the chair for occasional use. The gear trains coordinate the relative positions of the subassemblies such that positive open and closed positions can be achieved without excess exertion of force on the subassembly members. By holding the closed chair with one hand on the integrated back handle, the weight of the leg subassemblies will allow them to automatically unfold in a coordinated fashion to the open position. To refold the chair, the second hand grasps the front end of the seat and pivots it up to the back. The front and rear leg subassemblies can automatically refold in a coordinated fashion during this motion as controlled by the gear trains.

The gear boxes can be rigidly constructed to maintain gear train alignments and to withstand seating forces and operation forces. The gear boxes are connected to each other by a gear brace, which in turn is attached to the underside of the seat in some embodiments. Thus, the pivot mechanics of the folding chair are separate from the seat and allow alternate embodiments of seat design and construction. Also, the attachment of the subassemblies to the gear boxes completes the rigidity of each subassembly and allows for weight reduction in the legs and back support members.

To control a stop point in the open (i.e., use) position the gear boxes can feature abutments in the front housings that stop motion of the rear leg and back subassemblies. This method offers direct contact with the back and leg posts. In some embodiments, the abutments are replaced with internal structural features built-in to the gear housings and the mating gear elements. This approach provides a more aesthetically pleasing configuration but may result in a heavier construction technique.

To achieve structural stability in the open (use) position the front of the seat can be attached to the front leg subassembly by the angle stop subassembly. This acts as a brace to maintain the seat in the desired angled position for use. The angle stop can be a structural member connected at a lower end by two pivot points to the front leg posts. The upper end can have two pins that ride in slots created by the seat and the pivot cover subassembly. The pins allow the angle stop to pivot in place during unfolding and refolding of the chair. When unfolded, the angle stop acts as a brace and forms part of the chair lock. During refolding, the angle stop maintains consistent motion of the leg subassemblies.

The pivot cover subassembly attaches to the underside of the seat and contains and provides slots for angle stop pins. The main structural element is the u-shaped pivot bar, which is used to secure the chair in a locked position. The pivot bar is suspended within the cover and is secured to it with two axis pins that allow it to pivot. The front end has an extended protuberance that serves as a button. The back end has two recessed pockets which are fitted with two compression springs nested in the cover. These springs maintain the pivot bar in a neutral (locked) position. Above the spring pockets on the pivot bar are two angled surfaces that interface with the pins from the angle stop subassembly and prevent pin motion unless the button is depressed.

In some embodiments, the back, front and rear leg assemblies can be constructed in a similar fashion for efficiency in manufacture and final assembly. The back can be attached to extruded aluminum posts, which are in turn attached to a cast or molded common joint. The joint can be contoured to mate with the gear hubs in a socket fitting for structural integrity. The fastener can be used merely to secure the subassembly to the gearboxes.

In a similar fashion, the front and rear leg stringers can be attached to extruded aluminum posts that are attached to joints. The joints in turn can attach to the respective gear hubs with socket fittings secured with fasteners.

The back, front and rear leg stringers can be one-piece structural pieces that may be injection molded with gas assist. They can be fastened to the joints and extruded posts with rivets. The seat can be made in a similar process. In another embodiment, the back, front and rear stringers can be made using the blow molding process and can be fastened to the joints and extruded posts with threaded fasteners. This approach allows customer part upgrade and/or replacement. Both embodiments provide a high level of structural integrity and a lightweight chair.

The front leg stringer can be contoured at a sloping angle to allow backward foot motion. The upper edge can serve as a foot rest. In some embodiments, it also projects to the rear of the front posts to nest between the rear stringer in the folded position. The rear leg stringer preferably has two slots molded-in for security cable pass-through during event set up.

The seat and back surfaces can be contoured for comfortable sitting. The seat preferably is contoured and angled to allow water runoff if it is left out in the rain. Back contours can provide support for lumbar and thoracic regions. The back preferably has a built-in handle that is sized and sloped so the folded chair can be comfortably carried by a child in one hand or two chairs can be carried back-to-back by an adult.

In yet another embodiment, the back, front and rear leg posts are constructed of wood and can be attached to modified joints, back and leg stringers. In this design, the stringers can be cast aluminum for greater bottom weight. This added weight may be partially offset with back and seat designs that are made of perforated lightweight composites. This approach can be used in windy outdoor conditions to help prevent tip-over of the lightweight chair.

BRIEF DESCRIPTION OF THE DRAWINGS

These and other objects and advantages of the present invention will become more apparent from the following description taken in conjunction with the accompanying drawings.

DETAILED DESCRIPTION OF THE PREFERRED EMBODIMENT

Figure 1:
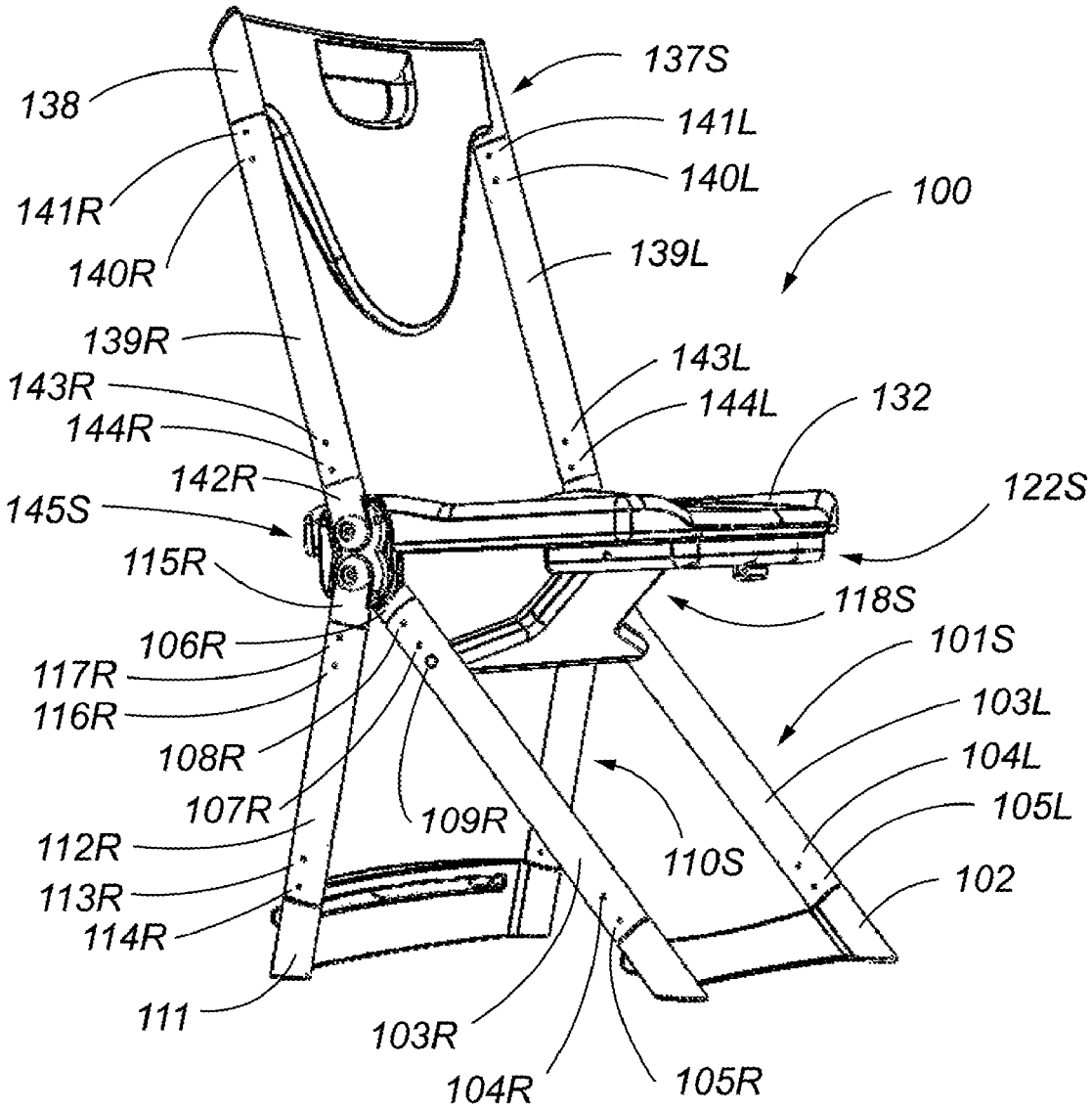
FIG. 1 is a side perspective view of one embodiment of a folding chair that is arranged and configured in accordance with certain features, aspects and advantages of the present invention.

Reference will now be made to the drawings wherein like numerals refer to like parts throughout. FIGS. 1-5 illustrate an embodiment of an open folding chair assembly 100 that is arranged and configured in accordance with certain features, aspects and advantages of the present invention. In some embodiments, the open folding chair assembly 100 comprises a seat 132 to which is attached a right gearbox subassembly 145S in a manner described below. The right gearbox subassembly 145S preferably is on the right side of the folding chair as defined by a user while sitting in the folding chair 100. In FIG. 2, a left gearbox subassembly 168S also is shown attached to the seat 132 on the left side in a manner similar to the right gearbox subassembly 145S. The gearbox subassemblies 145S, 168S control the folding motion of the chair 100 during opening and closing and are described in more detail below.

In the illustrated configuration, a front leg subassembly 101S is fastened to the right gearbox subassembly 145S with a joint 106R, and to the left gearbox subassembly 168S with a joint 106L. Two pins 107R, 108R preferably attach a post 103R, which can be extruded in some configurations, to the right joint 106R. Two additional pins 107L, 108L preferably attach a post 103L, which also can be extruded, to the left joint 106L. Other configurations also can be used.

The free ends of the posts 103R, 103L can be joined with a front stringer 102, which can be molded and can have mating integral shafts. Other configurations are possible. The right shaft preferably is secured to the right post 103R with pins 104R, 105R. The left shaft preferably is secured to the left post 103L with pins 104L, 105L. The stringer 102, which can have integral shafts, preferably provides a generally rigid substantially 90 degree connection with the posts 103R, 103L such that the front leg subassembly 101S is stable and is less likely to rock from side to side under load. Other configurations can be used.

In a similar manner, a rear leg subassembly 110S can be fastened to the right gearbox subassembly 145S with a joint 115R, and to the left gearbox subassembly 168S with a right joint 115L. Two pins 116R, 117R attach a right post 112R, which can be extruded, to the right joint 115R. Two additional pins 116L, 117L attach a left post 112L, which also can be extruded, to the left joint 115L. The free ends of the posts 112R, 112L preferably are joined with a rear stringer 111, which can be molded and which can have mating integral shafts. The right shaft can be secured to the right post 112R with pins 113R, 114R. The left shaft preferably can be secured to the left post 112L with pins 113L, 114L. The stringer 111, which can have integral shafts, preferably provides a generally rigid substantially 90 degree connection with the posts 112R, 112L such that the rear leg subassembly 110S can be stable and is less likely to rock from side to side under load.

Also, in a similar manner, a back subassembly 137S is fastened to the right gearbox subassembly 145S with a right joint 142R, and to the left gearbox subassembly 168S with a left joint 142L. Two pins 143R, 144R can be used to attach a post 139R, which can be extruded, to the right joint 142R. Two additional pins 143L, 144L can be used to attach a post 139L, which can be extruded, to the left joint 142L. The free ends of the posts 139R, 139L preferably are joined with a backrest 138, which can be molded and which can have mating integral shafts. The right shaft can be secured to the post 139R with pins 140R, 141R. The left shaft can be secured to the post 139L with pins 140L, 141L. The backrest 138 preferably provides a generally rigid substantially 90-degree connection with the posts 139R, 139L to reduce the likelihood that it will sway from side to side under pressure.

Figure 2:
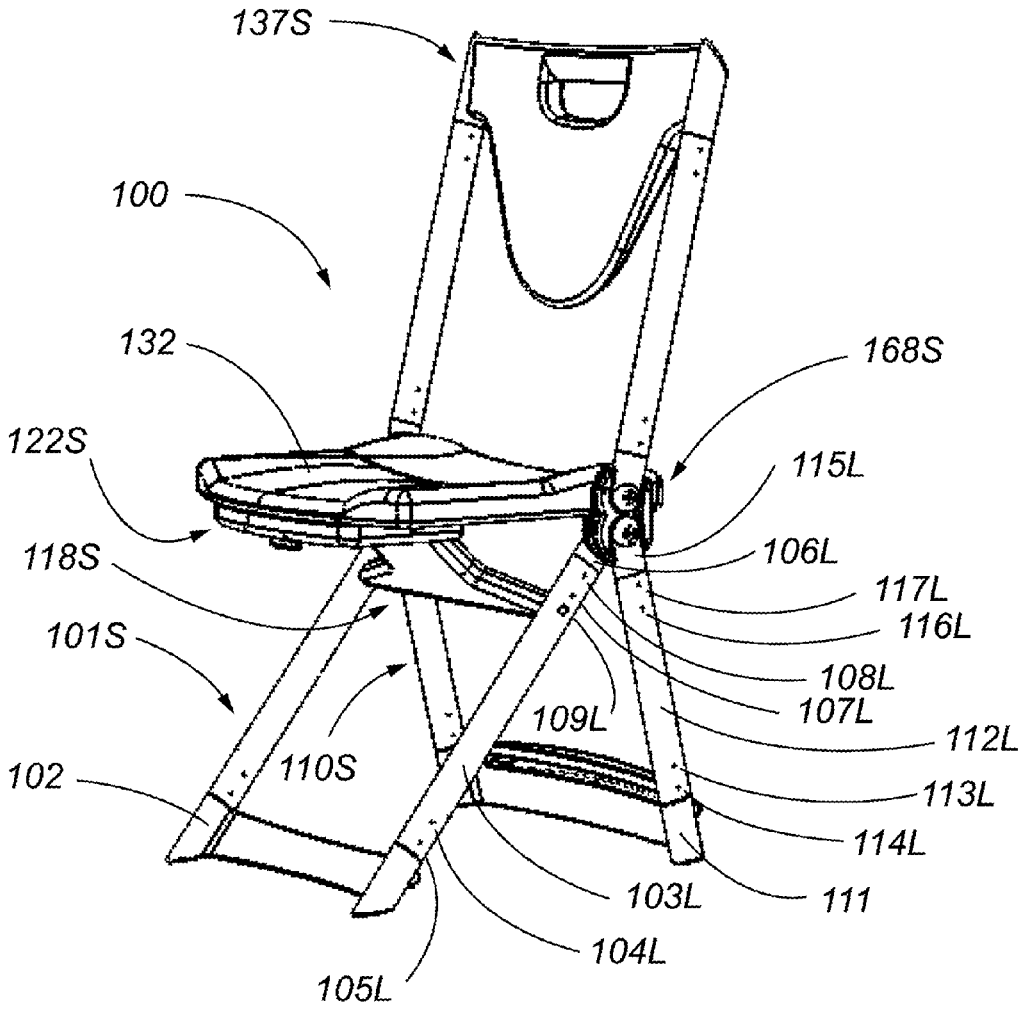
FIG. 2 is a front perspective view of the folding chair of FIG. 1.

An angle stop subassembly 118S is shown beneath the seat 132 in FIG. 1. The angle stop subassembly 118S preferably fits between the right post 103R and the left post 103L of the front leg subassembly 101S. The angle stop subassembly 118S preferably pivots in a coordinated fashion with both the front leg subassembly 101S and a pivot cover subassembly 122S. In the open locked position, the angle stop subassembly 118S forms a triangular brace with the seat 132 and the front leg subassembly 101S to rigidly support the seat 132 in a desired position. The angle stop subassembly 118S also increases lateral stability in the front leg subassembly 101S. The construction and connection details for the angle stop subassembly 118S and the pivot cover subassembly 122S are described further below.

A crossbrace 133 preferably connects the right gearbox subassembly 145S to the left gearbox subassembly 168S. In some embodiments, the crossbrace 133 also connects to the seat 132. The crossbrace 133 can have any suitable configuration and can be an extruded tube in some embodiments. The crossbrace 133 helps to stabilize the upper ends of the front leg subassembly 101S, the upper ends of the rear leg subassembly 110S, and the lower ends of the back subassembly 137S. In some embodiments where the seat 132 does not connect to the gearbox subassemblies 145S, 168S, the crossbrace can connect the seat 132 to the gearbox subassemblies 145S, 168S.

Figure 3:
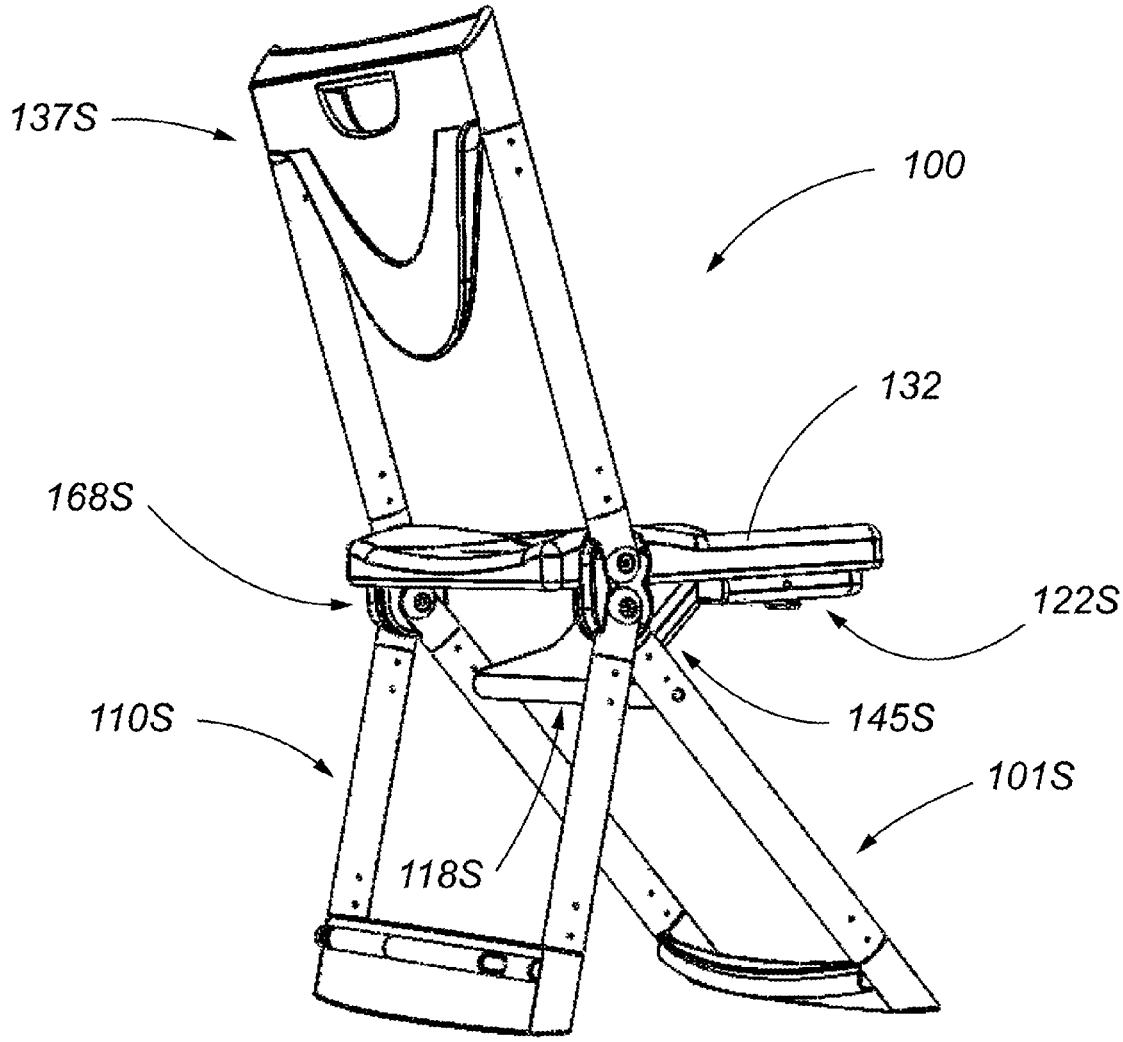
FIG. 3 is a rear perspective view of the folding chair of FIG. 1.
Figure 3A:
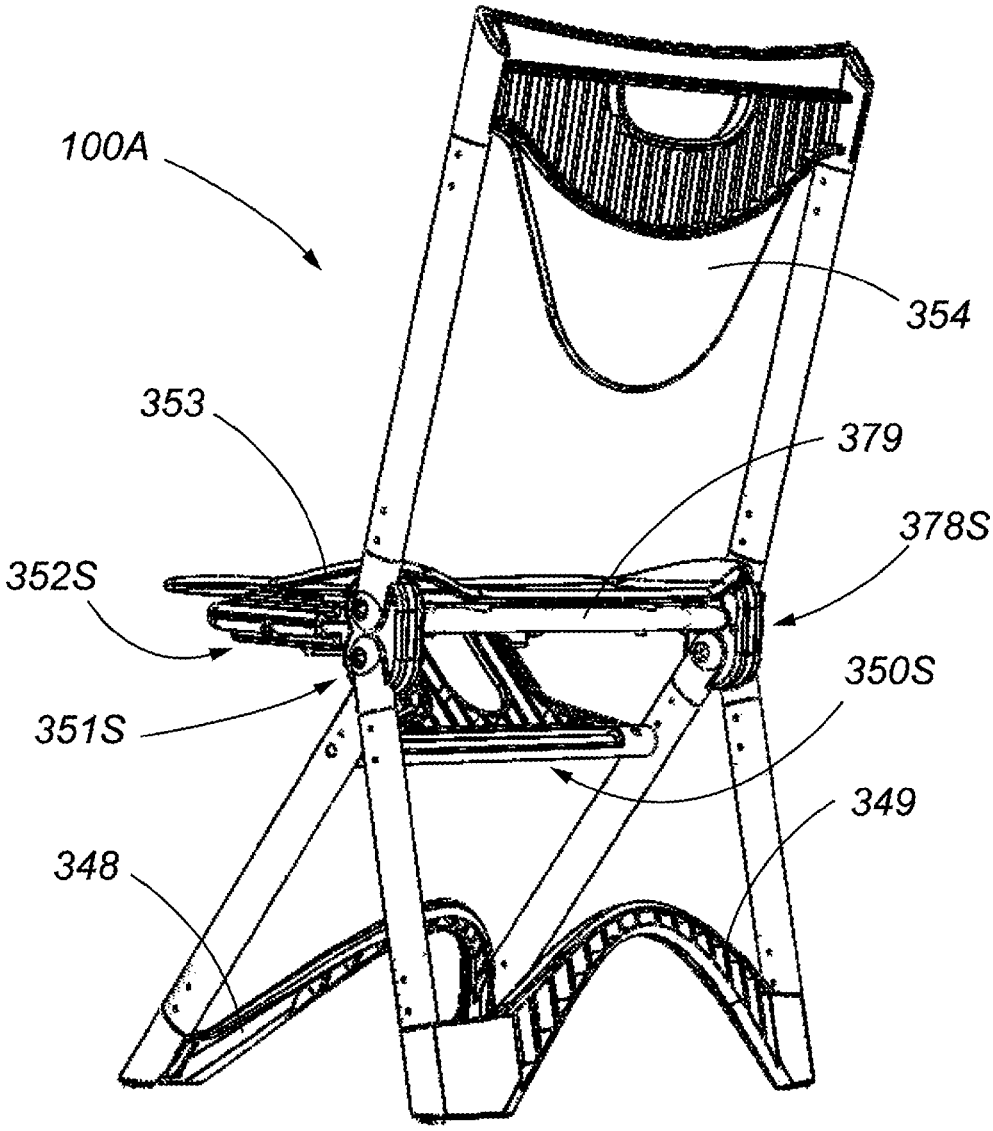
FIG. 3A is a rear perspective view of another embodiment of a folding chair that is arranged and configured in accordance with certain features, aspects and advantages of the present invention.

FIG. 3A shows the folding chair assembly 100 which is slightly modified such that it is arranged and configured in accordance with certain features, aspects and advantages of some embodiments of the present invention. In the illustrated configuration, a seat back 354, a front leg stringer 348 and a rear leg stringer 349 each can be one-wall structural pieces that are injection molded with ribs for additional strength where needed or desired. While all three are shown in this configuration, any one of these members can be formed as shown in either FIG. 3A or FIG. 3, for example. In addition, the illustrated angle stop subassembly 350S shown in FIG. 3A preferably uses injection molded plastic with structural ribs, such as within the angle stop 389. Moreover, as will be described further below, the angle stop 389 and the angle stop subassembly 350S can be slightly reconfigured when compared to the angle stop subassembly 118S introduced above and shown in FIG. 1.

A seat 353 in the construction illustrated in FIG. 3A preferably has a one-wall construction and can be mated with an enclosed version of a pivot cover subassembly 352S, and a crossbrace 379, which is described further below. Connected to the crossbrace 379 are a left gearbox subassembly 351S and a right gearbox subassembly 378S. The illustrated left gearbox subassembly 351S shows internal gear stops and construction details for the gearbox subassembly 315S are described below.

Figure 4:
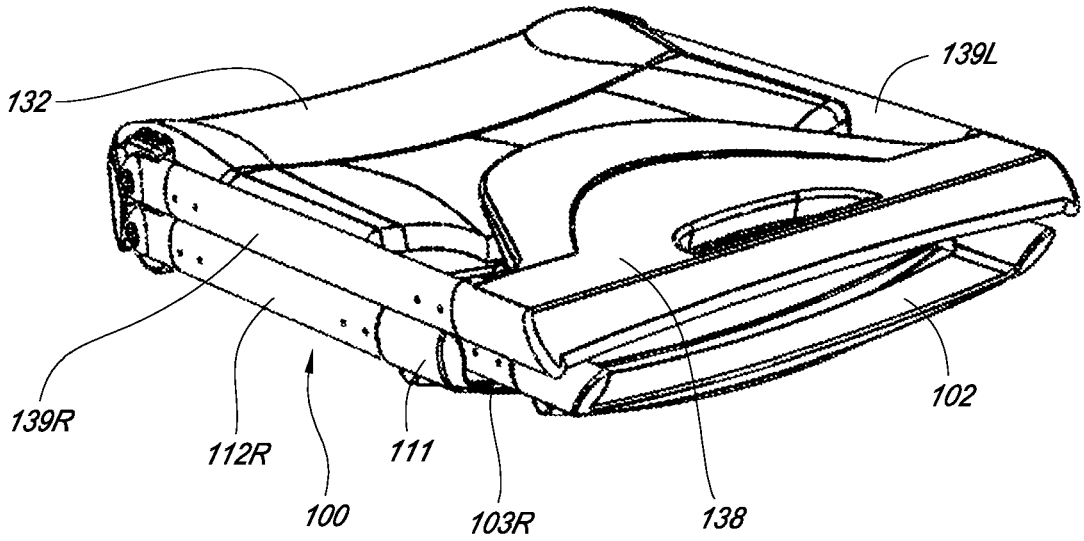
FIG. 4 is a perspective view of the folding chair of FIG. 1 in a collapsed position.
Figure 5:
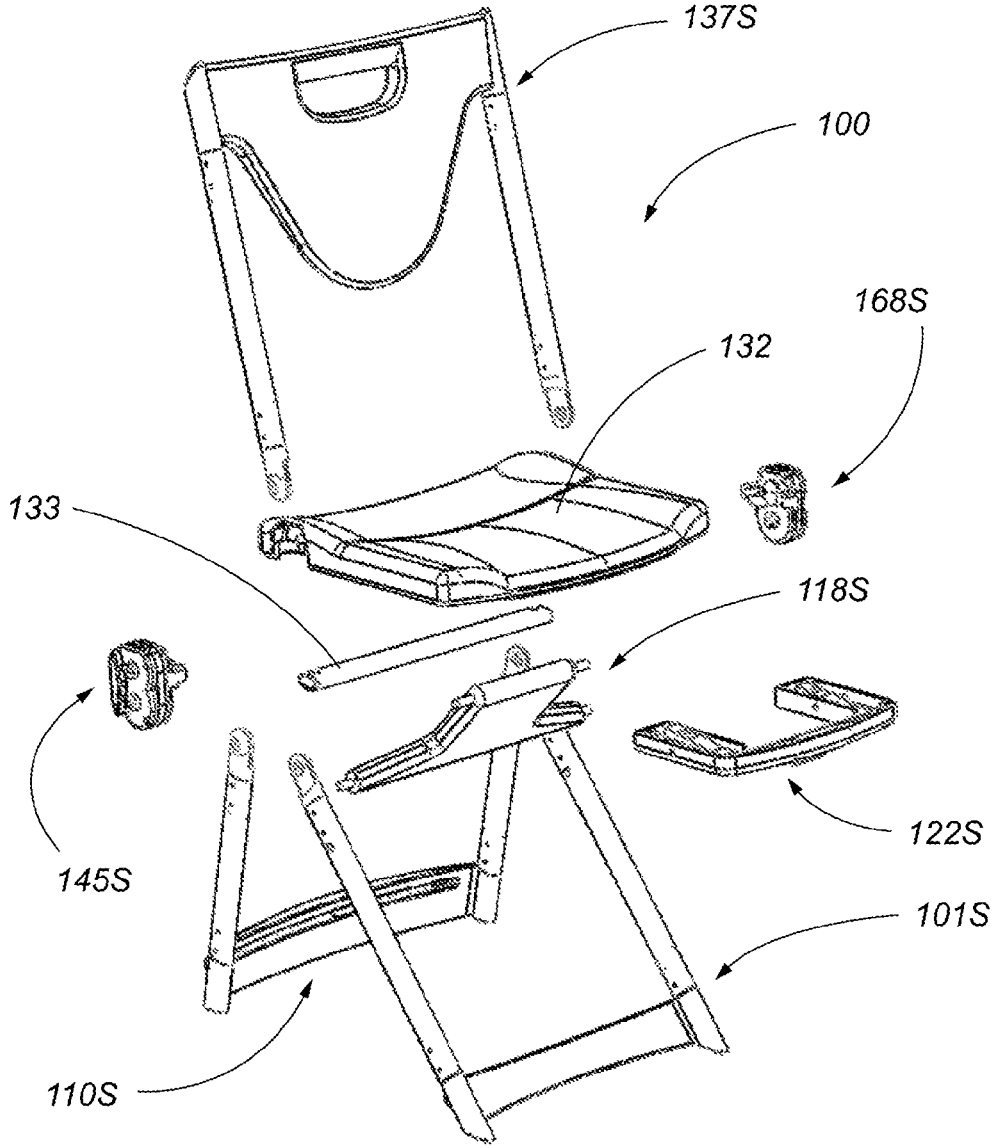
FIG. 5 is an exploded view of the main subassemblies of the folding chair of FIG. 1.

As discussed above, the chair assembly 100 can be folded for storage and carrying. FIG. 4 illustrates the chair assembly 100 in a folded configuration. As illustrated, the seat 132 folds into a space defined generally between the left and right posts 139L, 139R. In addition, a portion of the back 138 in the illustrated configuration overlies a portion of the seat 132. The front stringer 102 preferably lies along a portion of the back 138 when in the folded configuration. In addition, the front posts 103R, 103L preferably fold to a location inside of the rear posts 112R, 112L. Moreover, when folded, the illustrated rear posts 112R, 112L lie alongside the seat back posts 139R, 139L. Preferably, the front posts 103R, 103L are positioned between at least a portion of the rear stringer 111 and at least a portion of the seat back 138.

Thus, the illustrated folded chair assembly 100 generally defines two layers: a first layer generally comprising the seat 132, the seat posts 139R, 139L and the seat back 138; and a second layer generally comprising the front posts 103R, 103L, the rear posts 112R, 112L the front stringer 102 and the rear stringer 111. The two layers can be connected by the gearbox subassemblies 145S, 168S.

Figure 6:
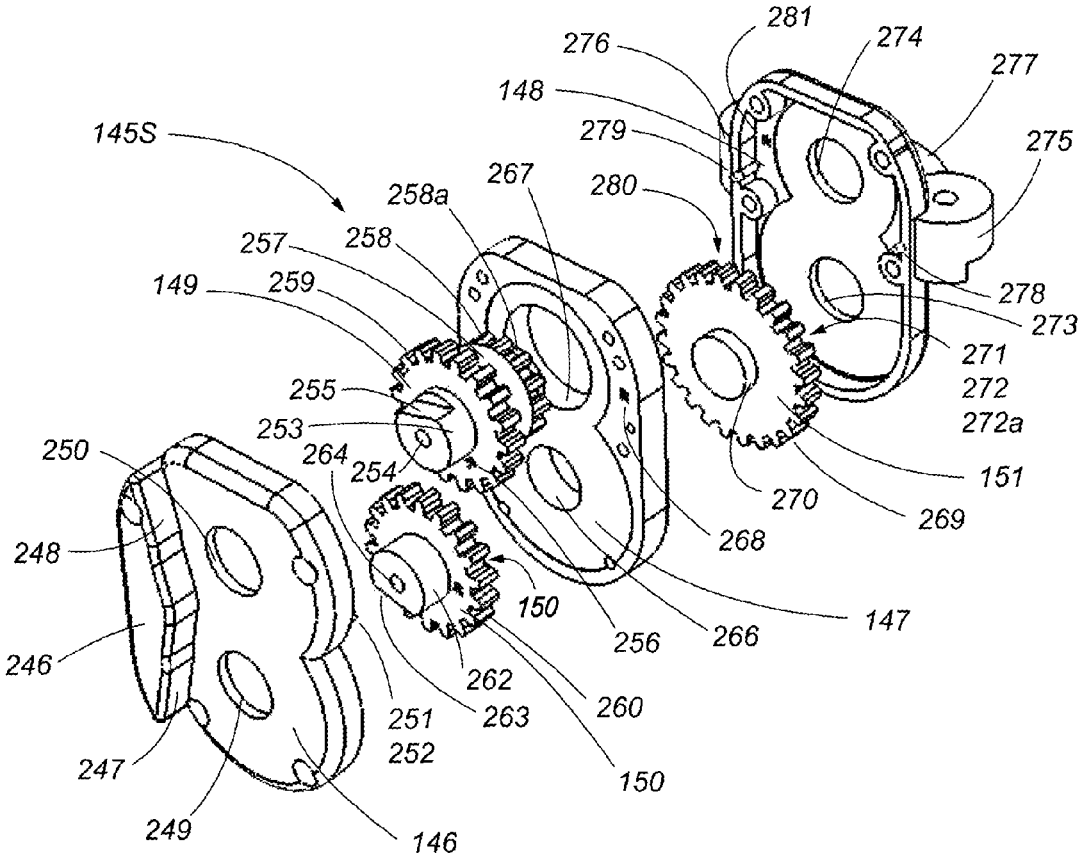
FIG. 6 is an exploded view of a right gearbox subassembly shown in FIG. 5.

Now turning to FIG. 6, details of the right gearbox subassembly 145S are illustrated. The illustrated gearbox subassembly 145S comprises three gear and axle combinations contained within three housings. A front housing 146 preferably connects to a middle housing 147 with four screws. Other mounting arrangements also can be used. Two alignment pins 251, 252 on a rear surface of the front housing 146 mate with corresponding holes in the middle housing 147.

A bulkhead 246 preferably protrudes from the front housing 146 and has an upper control surface 248 that is used to limit the travel of the backrest subassembly 137S, and specifically the joint 142R. A lower control surface 247 can be used to limit the travel of the rear leg subassembly 110S, and specifically the joint 115L. A 1.5R gear/axle 150 and a ComboR gear/axle 149 mesh and preferably are contained between the front housing 146 and the middle housing 147. The illustrated 1.5R gear/axle 150 has a protruding front axle hub 262 on the front side and a smaller protruding rear axle hub 265 at the rear. The front axle hub 262 fits into a bearing surface 249 of the front housing 146. The rear axle hub 265 fits into a bearing surface 266 of the middle housing 147.

In a similar manner, the ComboR gear/axle 149 has a protruding front axle hub 256 on the front side and a larger protruding rear axle hub 257 at the rear. The axle hub 256 fits into a bearing surface 250 of the front housing 146. The axle hub 257 fits into a bearing surface 267 of the middle housing 147. Gear teeth 260 of the 1.5R gear/axle 150 and gear teeth 259 of the ComboR gear/axle 149 preferably mesh with a 1:1 ratio.

The ComboR gear/axle 149 has additional gear teeth 258 extending beyond the rear axle hub 257 and beyond the middle housing 147. These teeth 258 have a 1:1.5 ratio with the gear teeth 259 of the ComboR gear/axle 149. Protruding beyond the gear teeth 258 is a smaller axle hub 258*a* that fits into a bearing surface 274 of a rear housing 148. The rear housing 148 attaches to the middle housing 147 with four screws in the illustrated configuration. Two alignment pins 278, 279 on a front surface of the rear housing 148 mate with corresponding holes in the middle housing 147.

The third gear/axle, identified as 2.0R gear/axle 151 has a protruding front axle hub 270 on a front side and a larger protruding rear axle hub 271 at the rear. The front axle hub 270 fits into the bearing surface 266 of the middle housing 147, but preferably has a separation space between its front hub 270 and the rear hub 265 of the 1.5R gear/axle 150. This separation space allows the two hubs 270, 265 to turn independently while sharing the same bearing surface 266. In other words, the two hubs 270, 265 preferably are axially spaced apart while being within the same region defined by the bearing surface 266.

The 2.0R gear/axle 151 has gear teeth 269 that mesh with the gear teeth 258 of ComboR gear/axle 149 with a 2:1 ratio.

The combination of ratios contained within the gearbox subassembly 145S allow the connecting subassemblies to move in a controlled coordination.

Extending beyond the rear surface of the rear housing 148 are two controlled mounting cylinders 275, 276 which are used to secure the gearbox subassembly 145S to the seat 132 using two screws, for example. The mounting cylinders 275, 276 preferably fit securely within molded pockets in the seat and are described further below. Also, extending beyond the rear surface in the illustrated configuration is a protrusion 277 that has a contour that fits securely within the crossbrace 133 and that is secured within the crossbrace 133 with a single fastener in the illustrated configuration.

External moving attachments to the gearbox subassembly 145S are the front leg subassembly 101S, the rear leg subassembly 110S and the backrest subassembly 137S. Common to each subassembly in the illustrated configuration and used for mating is the joint, referred to as the joint 106R, the joint 115R, and the joint 142R in the respective subassemblies. By using a component with a generally common construction, manufacturing costs and procedures can be simplified. The joint 106R mates with the protruding rear hub 271 of 2.0R gear/axle 151. The rear hub 271 can be aligned with the cutoff surface 272 of the hub 271 and, in the illustrated configuration, the socket fit can be secured with a central fastener and a metal threaded insert 273. Preferably, the threads are self-locking. Other constructions may use a lock washer and other secure fastener attachments, for example.

The joint 115R mates with the protruding hub 262 of 1.5R gear/axle 150. The hub 262 can be aligned with a cutoff surface 263 of the hub 262 and, in the illustrated configuration, the socket fit can be secured with a central fastener and a metal threaded insert 264.

In a similar manner, the joint 142R mates with the protruding hub 253 of ComboR gear/axle 149. The hub 253 can be aligned with a cutoff surface 255 of the hub 253 and, in the illustrated configuration, the socket fit can be secured with a central fastener and a metal threaded insert 254.

For assembly efficiency, it may be desirable for the joints 106L, 115R, and 142R to be attached to the gearbox subassembly 145S prior to attachment to their respective leg and back subassemblies. In such a configuration, the joints 106R, 115R, and 142R could be considered part of the gearbox subassembly 145S.

On each part within the right gearbox subassembly 145S, an identifying letter mark "R" can be molded or machined. The letter mark is used to distinguish the parts from those of left gearbox subassembly 168S, which do not have the letter marks. The letter marks are illustrated on their respective parts for items such as 256, 268, 280, 281, and 282.

Preferably, the gear/axles and the housings of gearbox subassembly 145S are made of die cast aluminum with bearing surfaces made of Delrin. Other materials can be used. The bearing surfaces may be integral or may be made as separate sleeves that fit over the hubs.

In some configurations, the gears can be made as reinforced injection molded plastic parts with integral bearing properties.

In some configurations, the gear teeth and the housings can be made of stamped steel and the gearbox subassembly 145S can be securely assembled with rivets. In such configurations, the gearbox will have a reduced width and can be somewhat tamperproof in that it cannot be readily disassembled and reassembled.

From the forgoing it can be appreciated that the gearbox subassembly 145S and the connecting subassemblies utilize a common joint assembly technique requiring minimal specialized tools as an advantage for product assembly. The use of controlled mating surfaces (e.g., the cutoff surface 272, the cutoff surface 263 and the cutoff surface 255) between parts also advantageously reduces the amount of fasteners needed and contributes to the lateral structural integrity of the assembled chair during load.

Figure 6A:
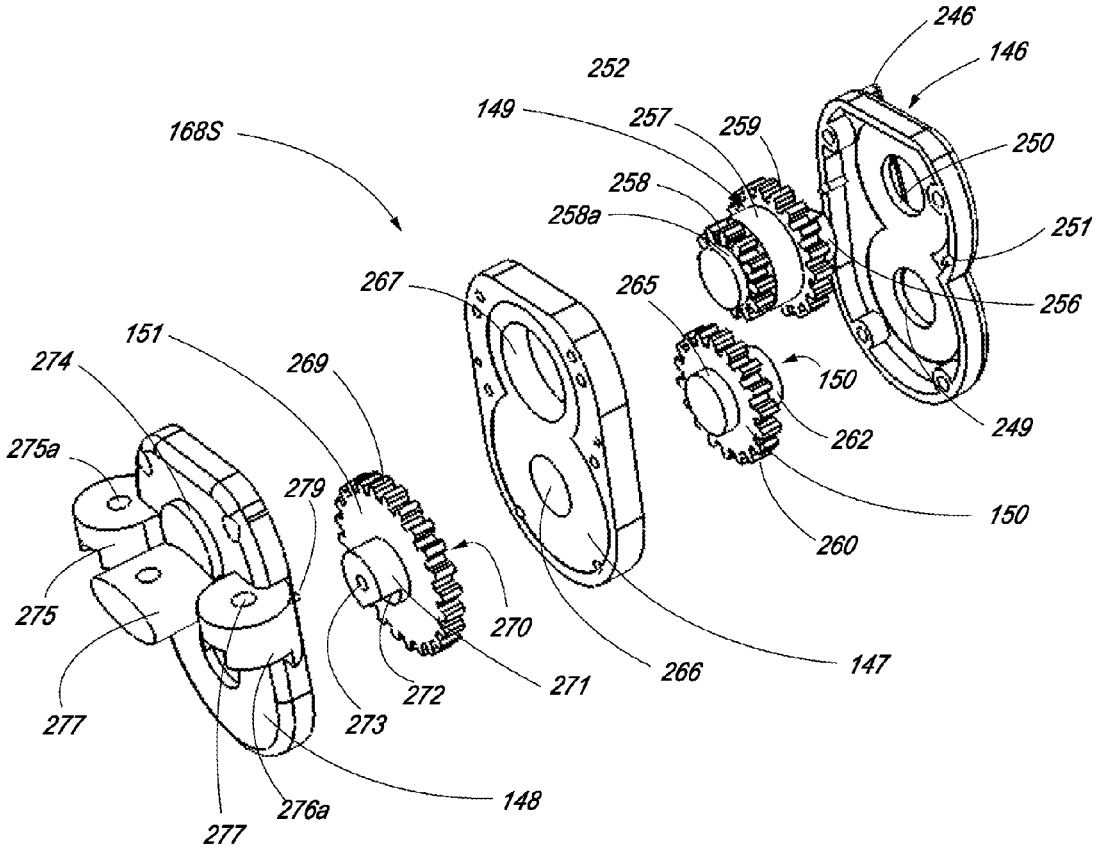
FIG. 6A is an exploded view of a left gearbox subassembly shown in FIG. 5.

FIG. 6A illustrates details of the left gearbox subassembly 168S. Gearbox subassembly 168S is a mirror of gearbox subassembly 145S. All parts are unique and readily distinguished from those of gearbox subassembly 145S as they are not marked with the identifying "R". Mates and assembly steps are as in FIG. 6 and the previous discussion. Moreover, the reference numerals will remain the same for the left and right unless otherwise indicated or apparent.

Figure 6B:
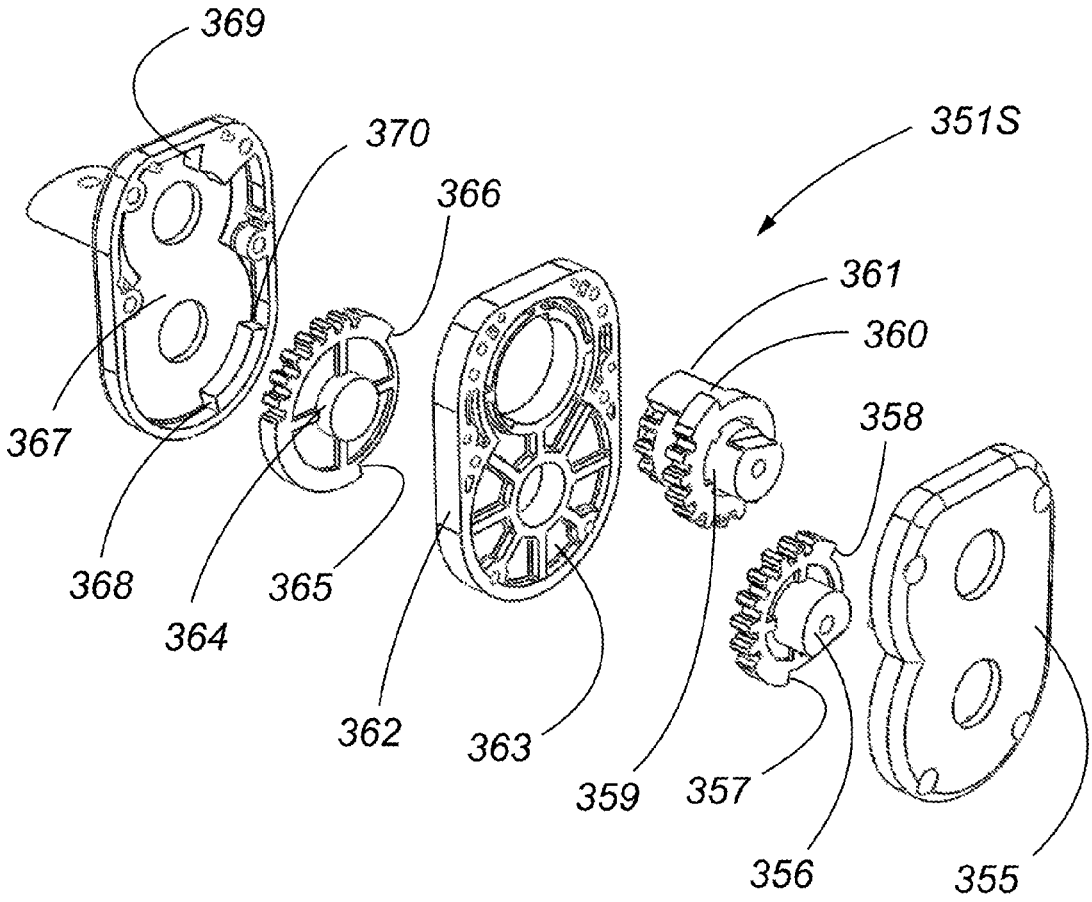
FIGS. 6B and 6C are exploded views of another configuration of a gearbox subassembly such as that shown in FIG. 3A.
Figure 6C:
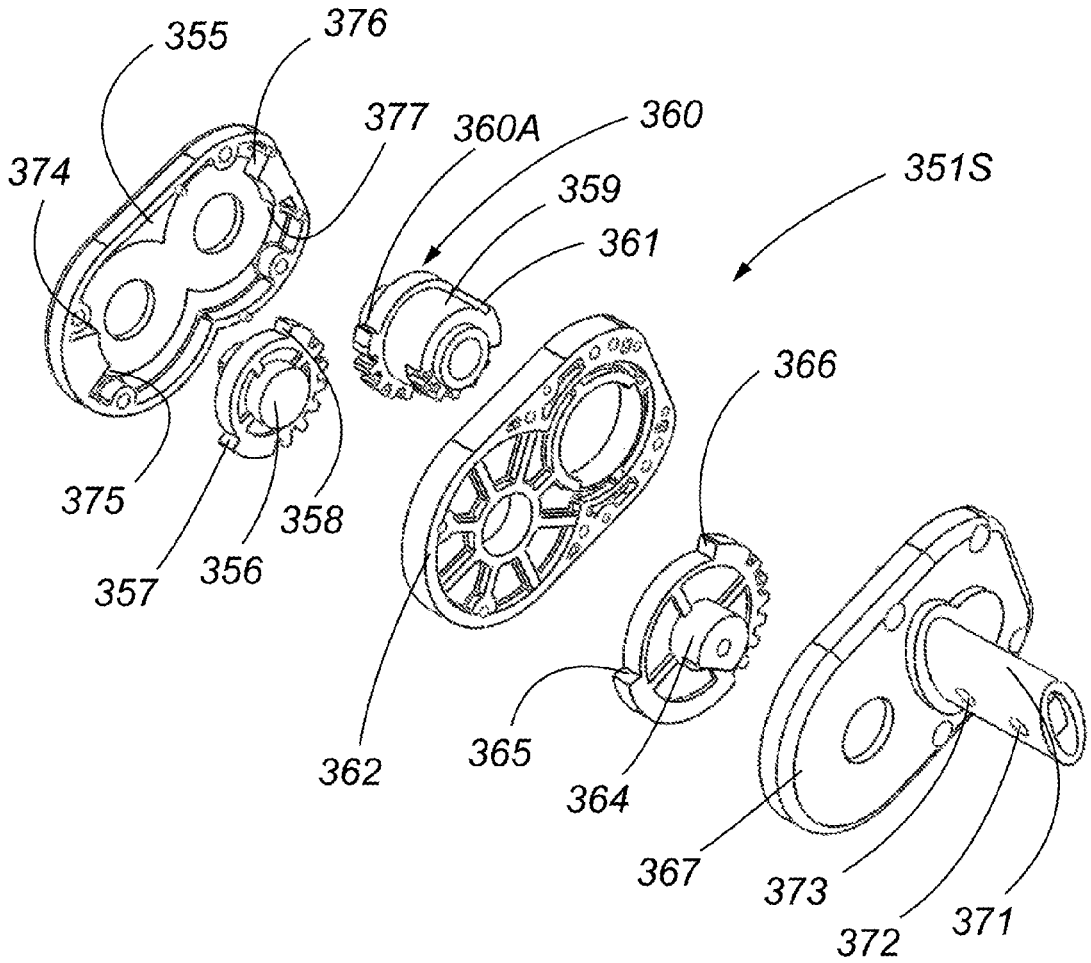

With reference to FIGS. 6B and 6C, other constructions of the left gearbox subassembly 351S are illustrated. The operation and construction approach of the configurations shown in FIGS. 6B and 6C are similar to left gearbox subassembly 168S described above. However, the left gearbox subassembly 168S comprises an internal gear stop control surface. The internal control surfaces replace the external bulkhead 246 shown FIG. 6A, or can be used together with the external bulkhead 246.

FIG. 6B illustrates three housings containing three gear/axles. A front housing 355 is shown without an external bulkhead. A Combo gear/axle 359 and a 1.5 gear/axle 356 have sufficient gear teeth for engagement within the about 104° of travel desired, but the remainder of the gear/axle bodies are configured to control and limit rotation. In other words, the remainder of the gear/axle body can be toothless. In a similar manner, a 2.0 gear/axle 364 has sufficient teeth for engagement with the Combo gear/axle 359 while the remainder of the body can be configured to control and limit rotation. A control surface 365 on the 2.0 gear/axle can contact a control surface 368 on a rear housing 367 to prevent further rotation of the front leg assembly 101S while opening the chair 100 and so serves as a stop or an internal bulkhead.

Additional control surfaces can be used for each gear/axle to provide a positive limit that corresponds to a stop position and to spread any load forces when the chair is being used. A control surface 361 of the Combo gear/axle 359 contacts a control surface 369 of the rear housing 367. A control surface 357 of the 1.5 gear/axle and a control surface 360 of the Combo gear/axle 359 contacts control surfaces positioned inside of the front housing 355 that are illustrated in FIG. 6C.

Secondary control surfaces also can be used when closing the chair assembly 100. A control surface 366 of the 2.0 gear/axle can contact a control surface 370 of the rear housing 367. Additional secondary control surfaces also are illustrated in FIG. 6C.

All gears/axles and housings preferably are made of diecast aluminum with bearing surfaces made of Delrin. The illustrated middle housing 362 is shown with cored sections 363 to reduce material and lighten weight. The gear/axles and other housings can be similarly cored as desired.

Now turning to FIG. 6C, the left gearbox subassembly 351S is illustrated from a reverse view to better illustrate some of the remaining control surfaces. The control surface 357 of the 1.5 gear/axle 356 can contact a control surface 375 of the front housing 355 to limit travel of the rear leg subassembly 110S during opening. The control surface 360 of the Combo gear/axle 359 can contact a control surface 377 of the front housing 355 to limit travel of the back subassembly 137S during opening.

Another secondary control surface 358 of the 1.5 gear/axle 356 contacts a control surface 374 of the front housing 355 to limit travel when closing the chair assembly 100. A control surface 360A also contacts a control surface 376 of the front housing 355 during this operation.

The illustrated rear housing 367 is shown with a slightly reconfigured shaft 371. The illustrated shaft 371 comprises two attachment holes 372, 373 for connection to the crossbrace 379, which can connect with the seat 353.

In some embodiments, the control surfaces and the secondary control surfaces of the front housing 355 and the rear housing 367 can be located on the middle housing 362 or can have a portion formed on the middle housing 362 with the remainder formed on the front and rear housings 355, 367. Moreover, in some configurations, the control surfaces and the secondary control surfaces can be formed on an insert that is received between the front and middle housings and the middle and rear housings. Any other suitable combinations also can be used. If the control surfaces and the secondary control surfaces are formed on the middle housing 362, the middle housing 362 increases in width to accommodate the control surfaces 368, 369, 375, 377 and the secondary control surfaces 370, 374, and 376. It also reduces structural requirements on the front housing 355 and rear housing 367 that would allow alternate process and material selections for the housings.

Figure 7:
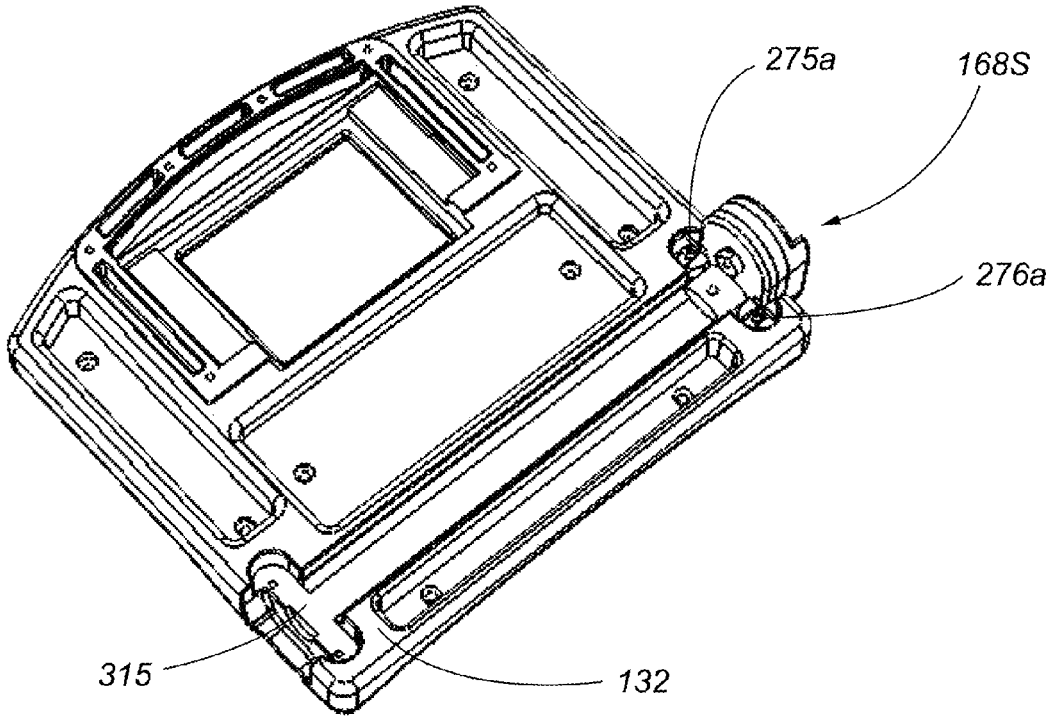
FIG. 7 is a bottom view of seat details from FIG. 5 with the left gearbox subassembly attached.

With reference to FIG. 7, the left gearbox subassembly 168S is illustrated in position relative to a bottom surface of the seat 132. The two mounting cylinders 275, 276 nest into a recessed pocket 315 molded into the seat 132 and can be secured by screws at mounting holes 275*a*, 276*a*. The recessed pocket 315 preferably extends across the width of the seat 132, allowing clearance room for the crossbrace 133, and then expands out to define a mounting position for the right gearbox subassembly 145S. In some configurations, the recessed pocket adds structural rigidity to the gearbox subassemblies because the gearbox subassemblies are mounted directly to the seat 132.

Figure 8:
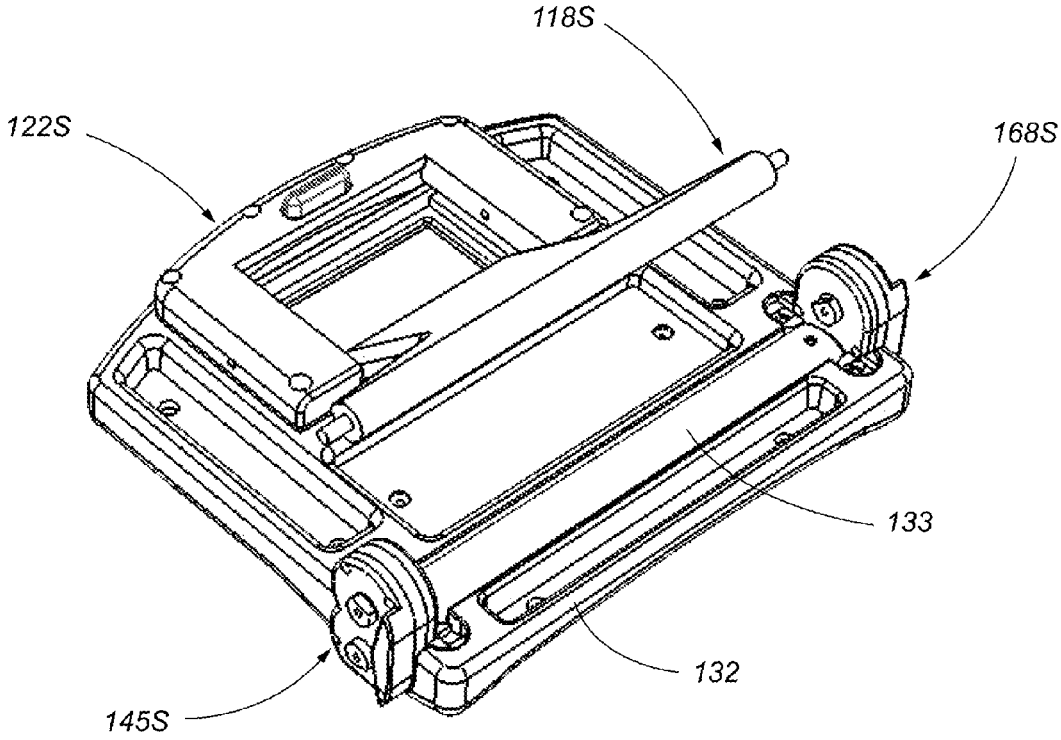
FIG. 8 is a bottom view of the seat of FIG. 5 with the remaining subassemblies of an angle stop, a pivot cover and the right gearbox attached, along with a gear brace.

FIG. 8 illustrates the bottom of the seat 132 with the gearbox subassembly 168S, the gearbox subassembly 145S, the pivot cover subassembly 122S, and the angle stop subassembly 118S in position and attached. The crossbrace 133 fits within the recess pocket 315 and is connected to the left gearbox subassembly 168S and the right gearbox subassembly 145S with one screw at either end. Other configurations are possible. In the illustrated configuration, when the crossbrace 133 is used, the crossbrace 133 preferably first is attached to the gearbox subassemblies 168S, 145S and then the completed unit can be secured to the seat 132 bottom. Other assembly techniques also can be used.

The angle stop subassembly 118S can be held between the seat 132 and the pivot cover subassembly 122S with two pins, as described below. In such a configuration, the pivot cover subassembly 122S is attached to the seat 132 bottom with, for example, six screws. In some configurations, the pivot cover subassembly 122S as well as the gearbox subassemblies 145S, 168S can be secured to the seat 132 bottom with rivets or tamperproof fasteners to hinder disassembly. Other configurations also are possible.

Figure 8A:
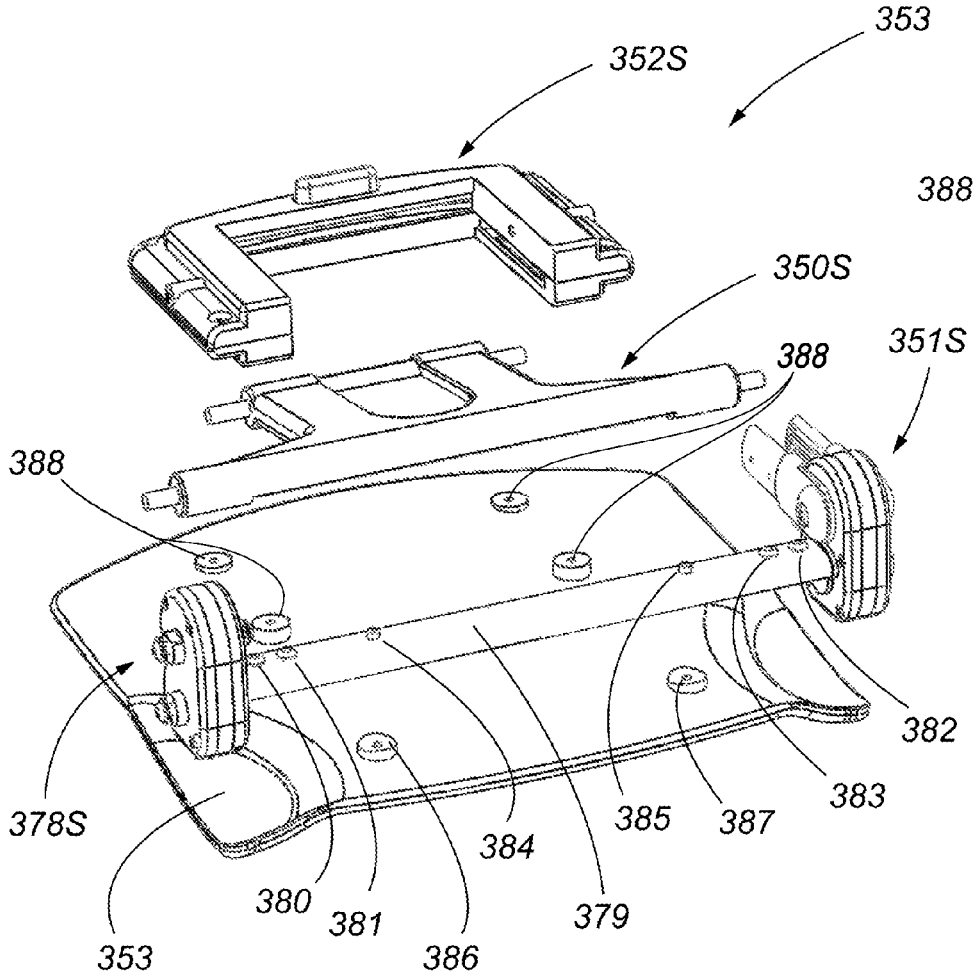
FIG. 8A is a bottom view of another configuration of a seat, gear brace, angle stop, pivot cover and gearbox subassembly such as that shown in FIG. 3A.

FIG. 8A is a bottom exploded view of another configuration of a seat 353 and the pivot cover subassembly 352S, the angle stop subassembly 350S, the gearbox subassembly 351S, and the gearbox subassembly 378S from FIG. 3A. The crossbrace 379 can be connected with two fasteners 380, 381, for example, to the right gearbox subassembly 378S, and with two fasteners 382, 383, for example, to the left gearbox subassembly 351S. The crossbrace 379, with the attached gearbox subassemblies 351S, 378S, is then attached with two additional fasteners 384, 385, for example, which connect to two respective bosses 386, 387 on the underside of the seat 353. The bosses 386, 387 can have a curved upper surface to mate with a curvature of the crossbrace 379 such that the components have a snug fit.

The angle stop subassembly 350S can be fitted to the pivot cover subassembly 352S, which can be connected to the bottom of the seat 353 at four bosses 388. Connection details are described further below.

Figure 9:
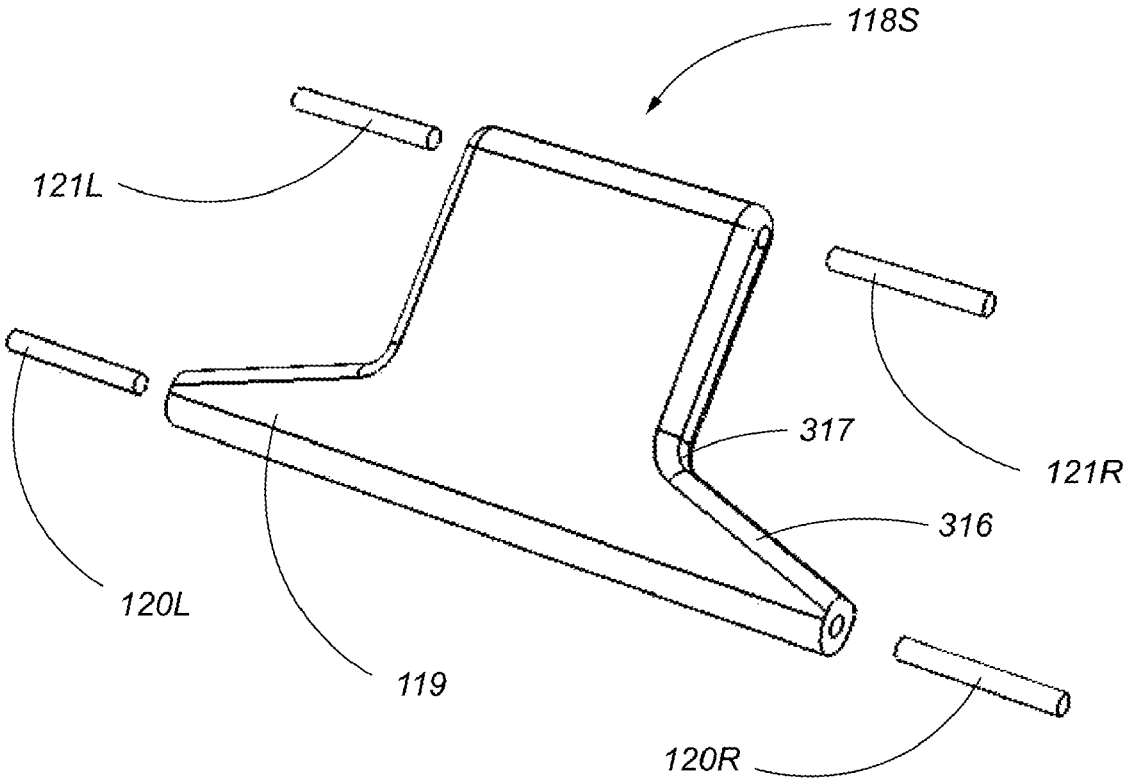
FIG. 9 is an exploded view of the angle stop subassembly of FIG. 5.

FIG. 9 is an exploded view of the angle stop subassembly 118S that illustrates four pins 120L, 120R, 121L, 121R that can be fitted to the molded angle part 119. The angle part 119 can be sized to fit between the posts of the front leg subassembly 101S. The pins 120L, 120R can fit into respective post holes 109L, 109R, which allows the angle stop subassembly 118S to pivot relative to the seat 132 and the front leg subassembly 101S during opening and closing of the chair 100.

The top portion of the angle part 119 can have a narrow construction such that the top portion of the angle part 119 can fit between the sides of the pivot cover subassembly 122S during closure of the chair 100. A transition ramp 316 and a radius 317 can be sized to provide strength to the angle part 119 so as to support the seat 132 while the chair 100 is open and to for generally avoid interference with the pivot cover subassembly 122S during closure. Pins 121L, 121R preferably fit between the pivot cover subassembly 122S and the seat bottom control surfaces described below. The assembly approach takes advantage of the molded seat 132 details to eliminate a control surface part used in conjunction with the pins 121L, 121R.

Figure 9A:
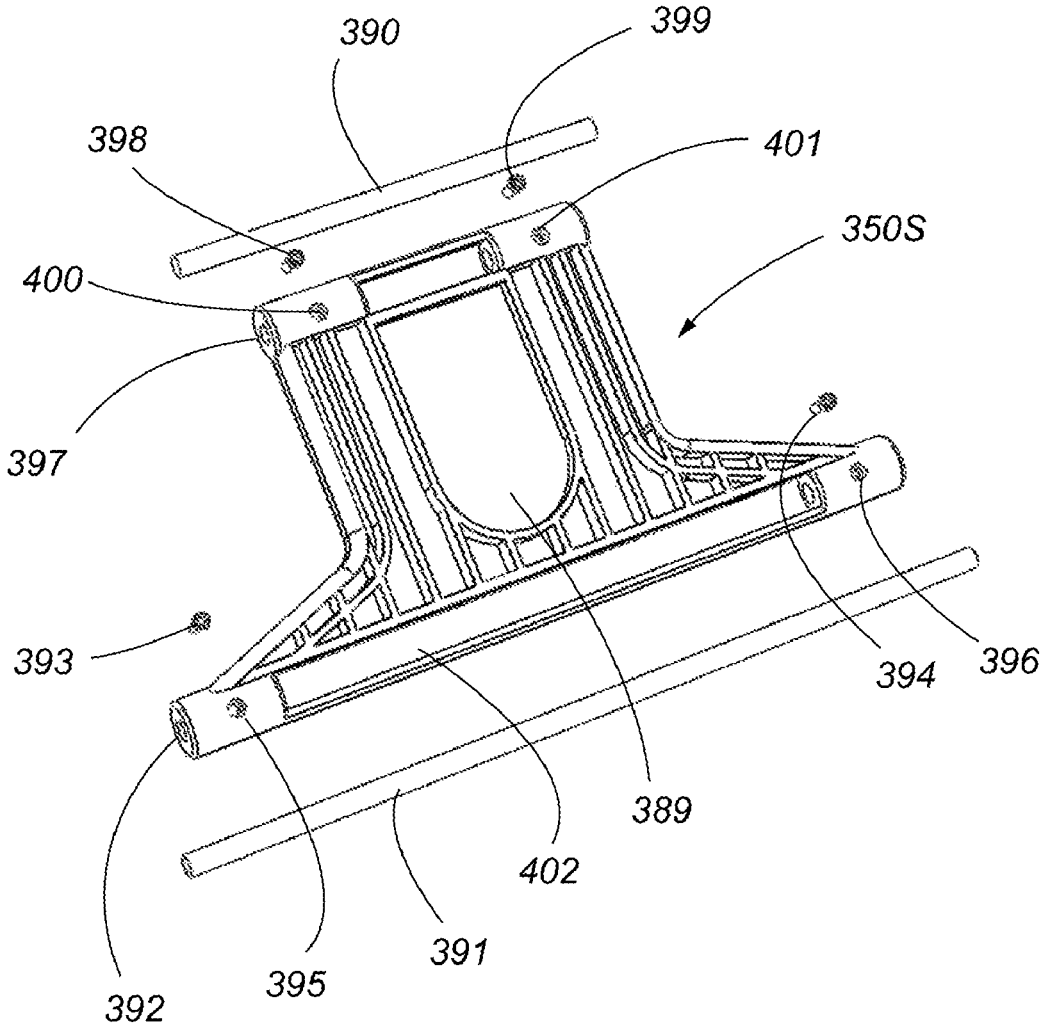
FIG. 9A is an exploded view of another configuration of an angle stop subassembly such as that shown in FIG. 3A.

FIG. 9A is an exploded view of another configuration of the angle stop subassembly 350S. This illustrated angle stop 389 can be an injection molded plastic part that has ribs for additional strength and that has cored-out areas 402 to reduce mass. FIG. 9A also illustrates two rods 390, 391 that are connected to the angle stop 389, which can be molded. The rod 390 slides into one end boss 397, is substantially centered within the angle stop 389 and is secured by two fasteners 398, 399. The fastener 398 preferably screws into a threaded hole 400 and the fastener 399 preferably screws into a threaded hole 401. Both fasteners 398, 399 can apply pressure to the rod 390 to secure the rod 390 in position. In some embodiments, the fasteners 398, 399 may pass through non-threaded holes in the angle stop 389 and can screw into threaded holes formed in the rod 390. The rod 390 may also be marked with an incised groove or have a protrusion near one end to establish a positive center position within the angle stop 389. In a similar manner, the rod 391 can slides into one end boss 392, can be centered within the angle stop 389, and can be secured by two fasteners 393, 394.

Figure 10:
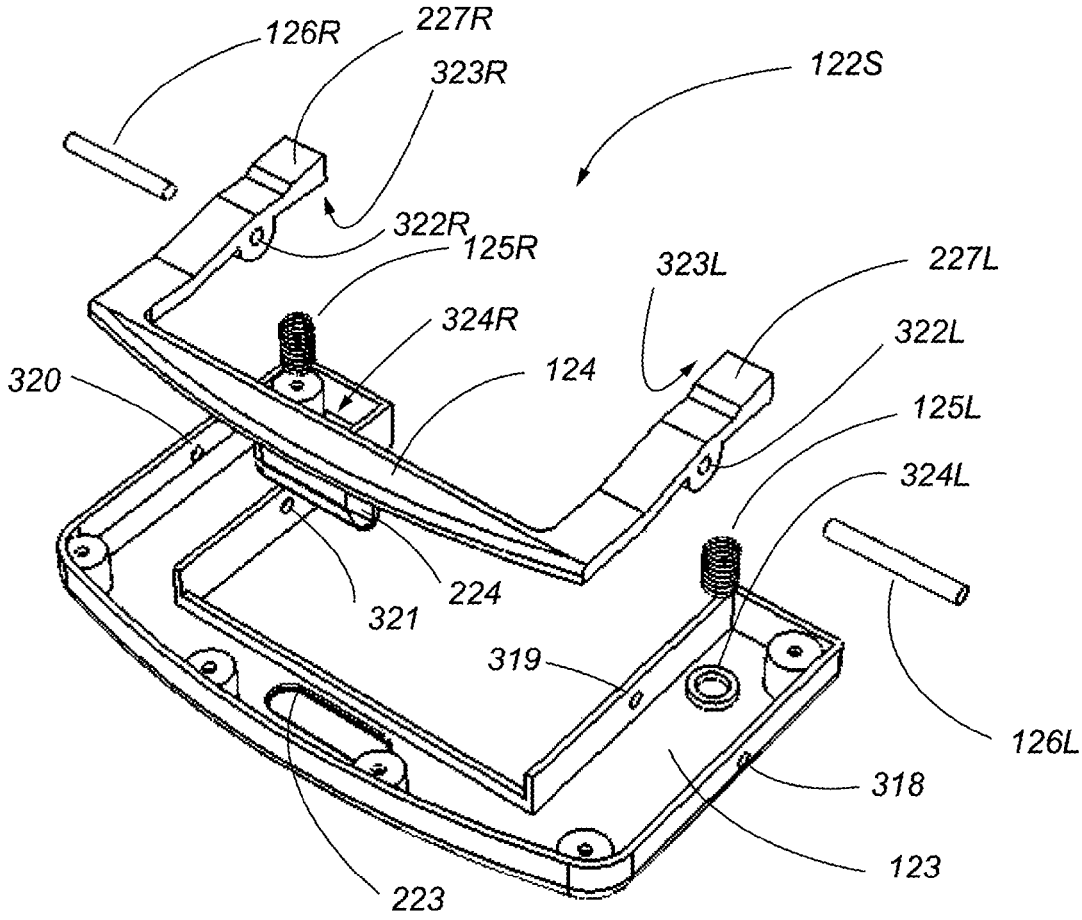
FIG. 10 is an exploded view of the pivot cover subassembly of FIG. 5.

FIG. 10 is an exploded view of the pivot cover subassembly 122S. In the illustrated configuration, a cover 123 connects directly with the bottom of the seat 132 using six fasteners, for example. In some embodiments, the pivot cover 123 can have a control enclosure part that would provide guidance for the pins 121L, 121R of the angle stop subassembly 118S. In some embodiments, the components of the pivot cover subassembly 122S are substantially fully enclosed such that flexible mesh seats also can be used.

A pivot arm 124 preferably connects to the cover 123 with pins 126L, 126R, for example. The pin 126L fits into a bearing surface hole 318, passes through a boss hole 322L on the pivot arm 124 and fits into a bearing surface hole 319 on the left wall of the cover 123. In a similar manner, the pin 126R fits a bearing surface hole 320, passes through a boss hole 322R on the pivot arm 124 and fits into a bearing surface hole 321 on the right wall of the cover 123. The pivot arm 124 maintains a rest position under pressure supplied by two compression springs 125L, 125R. A spring 125L is contained by a ring wall 324L in the pivot cover 123 and by a cylindrical cup 323L in the pivot arm 124. In a similar manner, a spring 125R can be contained by a ring wall 324R in the pivot cover 123 and by a cylindrical cup 323R in the pivot arm 124.

In the rest position, a central handle 224, which can be molded as part of the pivot arm 124, passes through an opening 223 in the pivot cover 123. The rest position of the pivot arm 124 can be changed by pressing on the central handle 224. This causes the pivot arm 124 to change angular position relative to the seat 132 and, in particular, to change the angular position of ramp surfaces 227L, 227R. The purpose of changing the rest position of the pivot arm 124 is to unlock the chair 100 for folding.

Figure 10A:
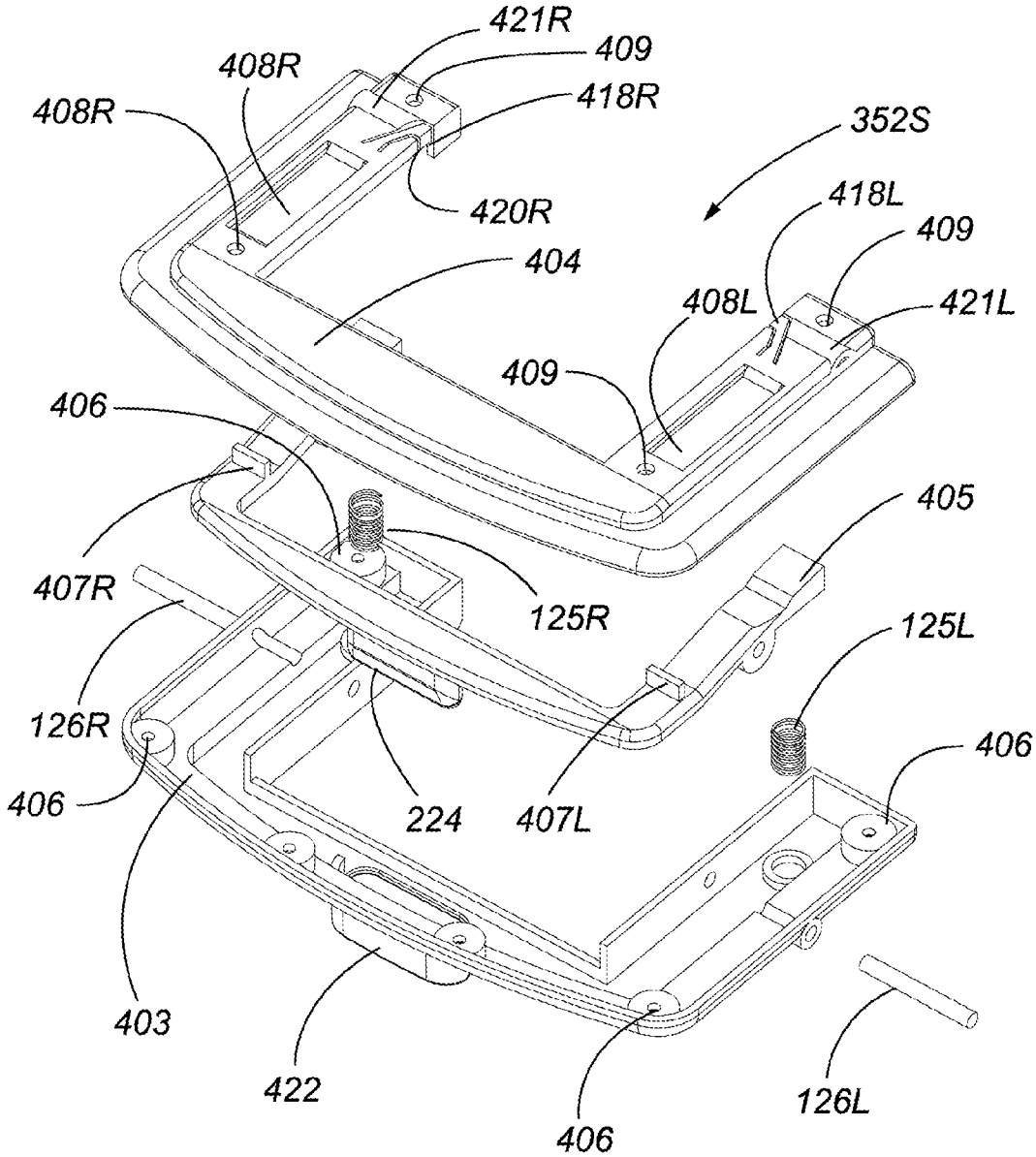
FIG. 10A is an exploded view of another configuration of a pivot cover subassembly such as that shown in FIG. 3A.

The ramp surfaces 227L, 227R control and lock the position of the pins 121L, 121R of the angle stop subassembly 118S as described below. It can be appreciated that the molded central handle 224 offers a single point of user contact to disengage the two ramp surfaces and free the pins 121L, 121R, compress the angle stop subassembly 118S, and allow the chair to fold compactly in an orderly manner controlled by the gear box subassemblies 145S, 168S. In some embodiments, the molded pivot arm 124 and the pin arrangement can be constructed as a sheet metal part with riveted pivot joints. Other configurations also are possible FIG. 10A is an exploded view of another pivot cover subassembly 352S. As discussed above, the illustrated pivot cover subassembly 352S has a control enclosure part 404 that provides guidance for the pins 121L, 121R of the angle stop subassembly 118S, or the corresponding ends of the rod 390 of the other illustrated angle stop subassembly 350S. The control enclosure part 404 connects to a cover 403 at six boss 406 locations, for example. In some embodiments, the control enclosure part 404 can connect to the seat 353 at four holes 409. Other configurations also are possible.

In the illustrated configuration, between the cover 403 and the control enclosure part 404, a pivot bar 405 is mounted with two pins 126L, 126R. Springs 125L, 125R also can be fitted as described above. The pivot bar 405 preferably has two upward extensions 407L, 407R that mate with corresponding downward extensions of the control enclosure part 404. The downward extensions are part of cantilevered beams 408L, 408R, which can be molded as part of control enclosure part 404. Other configurations also are possible.

These cantilevered beams 408 are used to trap the pins and the rods of the respective angle stop subassemblies 118S, 350S in order to lock the chair 100 in the closed position. Locking the chair into the closed position reduces the likelihood of the chair unfolding while the chair is being carried, for example. The central handle 224, which can be molded as part of the pivot bar 405, can be depressed to unlock the chair when it is in a closed position. Details of this operation are illustrated and described below.

Cantilever springs 418L, 418R can be molded into the upper surface of the control enclosure part 404 and can apply downward pressure to the pins and rods of the respective angle stop subassemblies 118S, 350S. The cantilever springs 418L, 418R are used in conjunction with extended track pockets 421L, 421R to reduce the likelihood of inadvertent chair closure while the chair 100 is in use. Details are described and illustrated below.

A surround wall 422 can be used to reduce the likelihood of inadvertent pressing of the central handle 224 while the chair is in use. While sitting in the chair 100, people may attempt to grasp a front edge of the seat and pull it forward or push it rearward. The surround wall 422 reduces the likelihood of inadvertent pressing of the central handle 224 in this situation.

As illustrated, the assembly sequence would have the control enclosure part 404 mounted first to the bottom of the seat 132 using the four mounting holes 409, for example. The angle stop subassembly 350S would be laid in position next, and the cover 403 with the pre-assembled pivot bar 405 and the attached pins 126L, 126R and springs 125L, 125R, would be attached at the six boss 406 locations, for example.

In some embodiments, four clearance holes are added in the cover 403 and the clearance holes generally align with the four attachment holes 409 of the control enclosure part 404. The clearance hole addition would allow driver access to the four fasteners of holes 409 and so enable seat replacement without disassembly of the pivot cover subassembly 352S.

In addition, the size of the central handle 224 on the pivot bar 405 can be reduced so that the central handle 224 can be contained within the cover 403 at all times. The opening 223 would be reduced in size so that only a small diameter tool could be inserted into the opening 223 to push the reduced-size central handle 224 to release the rod 390. The tool diameter would be sized to reduce the likelihood of finger access and to reduce the likelihood of inadvertent operation.

Figure 11:
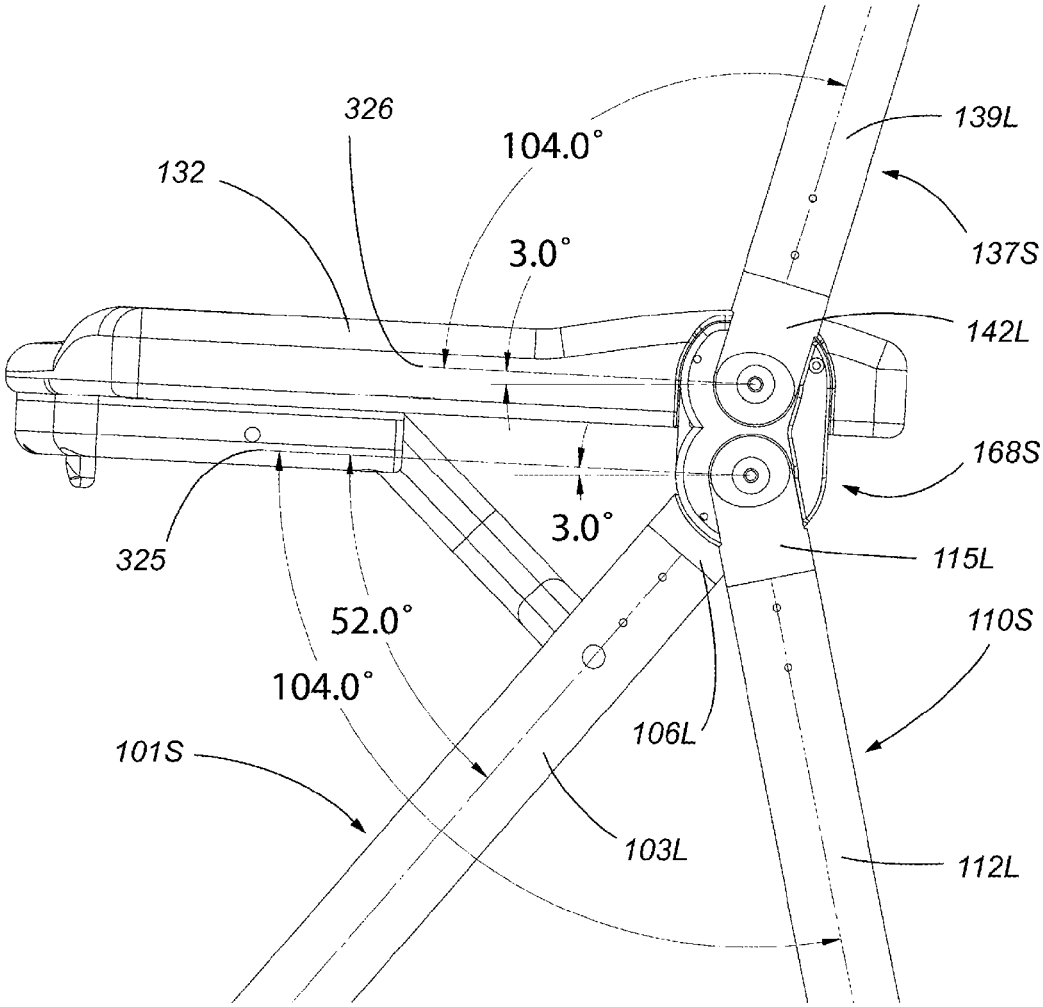
FIG. 11 is a detailed side view of a preferred embodiment of the folding chair of FIGS. 1-3 illustrating the angular relationships of the front leg, rear leg, and back subassemblies with the seat.

FIG. 11 is a side view of the chair 100 showing some of the angular relationships of the seat 132 relative to the back subassembly 137S, the front leg subassembly 101S, and the rear leg subassembly 110S. While certain angles are shown, the angles can differ somewhat from those shown depending upon the application. In the fully opened and locked position shown, the illustrated seat 132 tilts rearward about 3° relative to a horizontal plane that is generally parallel to the ground. This orientation sets up reference planes 325, 326, which are generally parallel to the generally flat bottom of the seat 132. The angular relationships can be measured from the reference planes 325, 326.

The rear leg assembly 110S is about 104° from the reference plane 325 as measured from the centerline of post 112L. The back assembly 137S is about 104° from the reference plane 326 as measured from the centerline of post 139L. When folded in the closed position, the rear leg subassembly 110S will pivot at the joint 115L in line with the reference plane 325 until it comes to a stop substantially coincident with the reference plane 325. In a similar manner, the back subassembly will pivot at the joint 142L in line with the reference plane 326 until it comes to a stop substantially coincident with the reference plane 326. In the closed position, the back subassembly post 139L and the rear leg subassembly post 112L will be generally parallel to each other and separated by a small clearance distance.

The front leg subassembly 101S is about 52° from the reference plane 325 as measured from the centerline of post 103L. When folded in the closed position, the front leg subassembly 101S will pivot at the joint 106L in line with the reference plane 325 until it comes to a stop substantially coincident with the reference plane 325. The angular travel of about 52° of the front leg subassembly is half of about 104° of the rear leg subassembly and similarly half of about 104° of the back subassembly.

It can be appreciated that the stance of the chair 100 in the fully opened locked position is at least partially determined by the angular relationships described above. The coordinated motion of the front leg subassembly 101S, the rear leg subassembly 110S, and the back subassembly 137S as controlled by the left gear box subassembly 168S and the right gearbox subassembly 145S is limited and can be determined by the angular relationships described above. Further, the gear ratios within the gearbox subassemblies 137S, 168S are at least partially determined by the angular relationships as described above, and in turn effect the stance of the chair 100.

Also, the back angle of about 104°, the seat angle of about 3°, the seat height, the back contour, and the seat contour can be determined by ergonomic considerations of the user. Alteration of one or more of the angular relationships and back 138 and seat 132 contours will affect the comfort of the chair 100 for the user.

Figure 12:
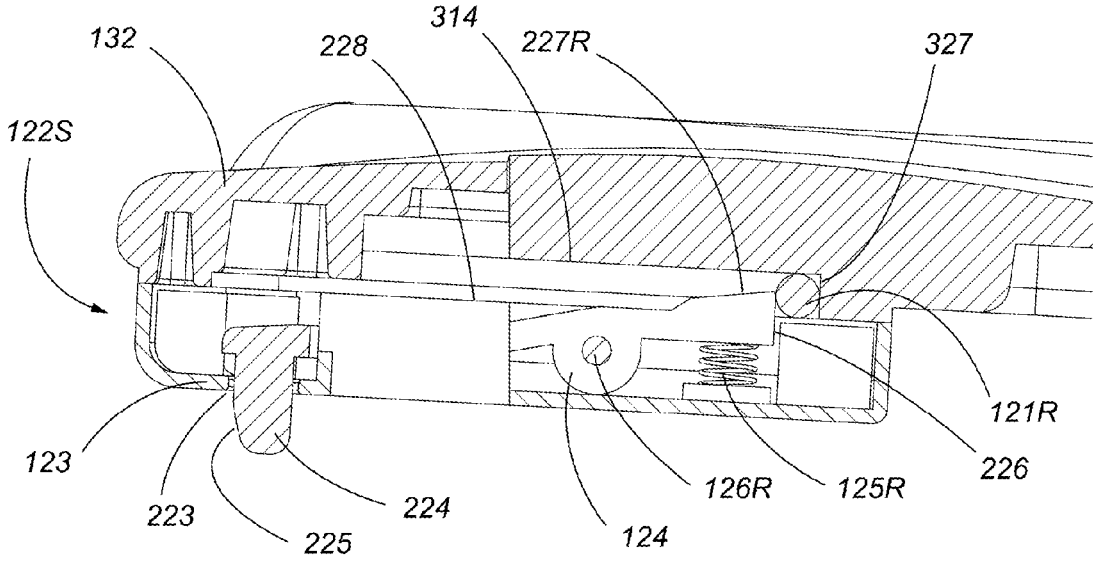
FIGS. 12, 12A are centerline section views of an assembled preferred embodiment of the folding chair of FIGS. 1-3 illustrating locked and unlocked positions of the pivot bar within the pivot cover subassembly.
Figure 12A:
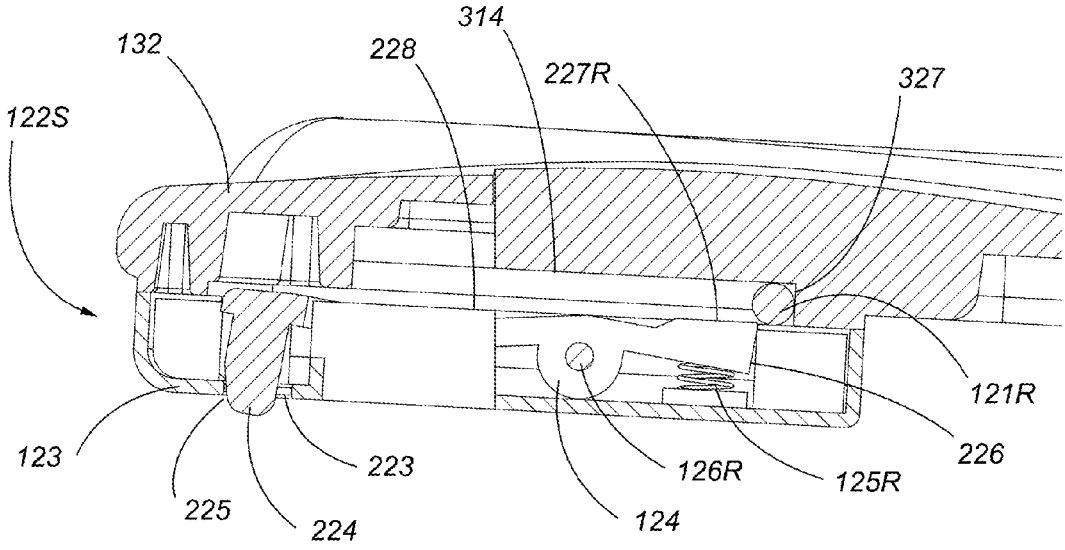

FIG. 12 and FIG. 12A are centerline section views of a portion of the folding chair 100. FIG. 12 illustrates the locked position of the pivot arm 124, while FIG. 12A illustrates the unlocked position of the pivot arm 124. In FIG. 12 the pivot arm 124 is shown mounted on the pin 126R, which is fitted into the pivot cover 123 that is installed onto the seat 132. The pivot arm 124 is in the rest position and held in place by the compression spring 125R. In this position, a rear surface 226 of the pivot arm 124 preferably substantially blocks forward travel of the pin 121R of the angle stop subassembly 118S. Since the pin 121R in this position also is less likely to move in any of the rearward, upward, and downward directions, it is effectively locked in place, and the chair 100 is locked in the open position.

In FIG. 12A, the central handle 224 has been depressed to unlock the chair 100. The central handle travels up through the opening 223 in the pivot cover 123. At the same time, rearward of the pivot pin 126R, the ramp surface 227 travels down so that it is substantially coincident with the bearing wall 228 of the pivot cover 123. In this position, the pin 121R is free to travel forward, and the chair 100 is unlocked and can be folded. The pin 121R travels between two generally parallel planar surfaces 228, 329 of the pivot cover 123 and of the seat 132, respectively. In some embodiments, the upper surface 314 may be created as part of an enclosing part which is attached to the pivot cover 123 and becomes part of the pivot cover subassembly 122S.

To open and lock the chair 100, the coordinated unfolding of the front leg subassembly 101S, the rear leg subassembly 110S and the back subassembly 137S cause the angle stop subassembly 118S to also move and the pin 121R to travel rearward. As the pin 121R travels rearward, it engages the ramp angle surface 227R of the pivot arm 124 causing the ramp angle surface 227R to pivot downward. As the ramp angle surface 227R pivots downward, it encounters increasing resistance due to the increased pressure created by the compression spring 125R. When the downward movement reaches a point where the ramp angle is generally coincident with the bearing surface 228, the pin 121R can pass further until it is stopped by a seat wall 327. At this point, the pin has passed the rear surface 226 of the pivot arm 124, and the pivot arm 124 now travels upward due to the compression spring 125R pressure, effectively locking the pin 121R and the chair 100 in the open position.

The central handle 224 fits within the opening 223 in the pivot cover 123 and has minimal clearance in the rest position. When depressed, the central handle 224 travels upward in an arc and so the front surface 225 is contoured in a concentric arc to reduce the likelihood of interference with the leading edge of the opening 223.

Figure 12B:
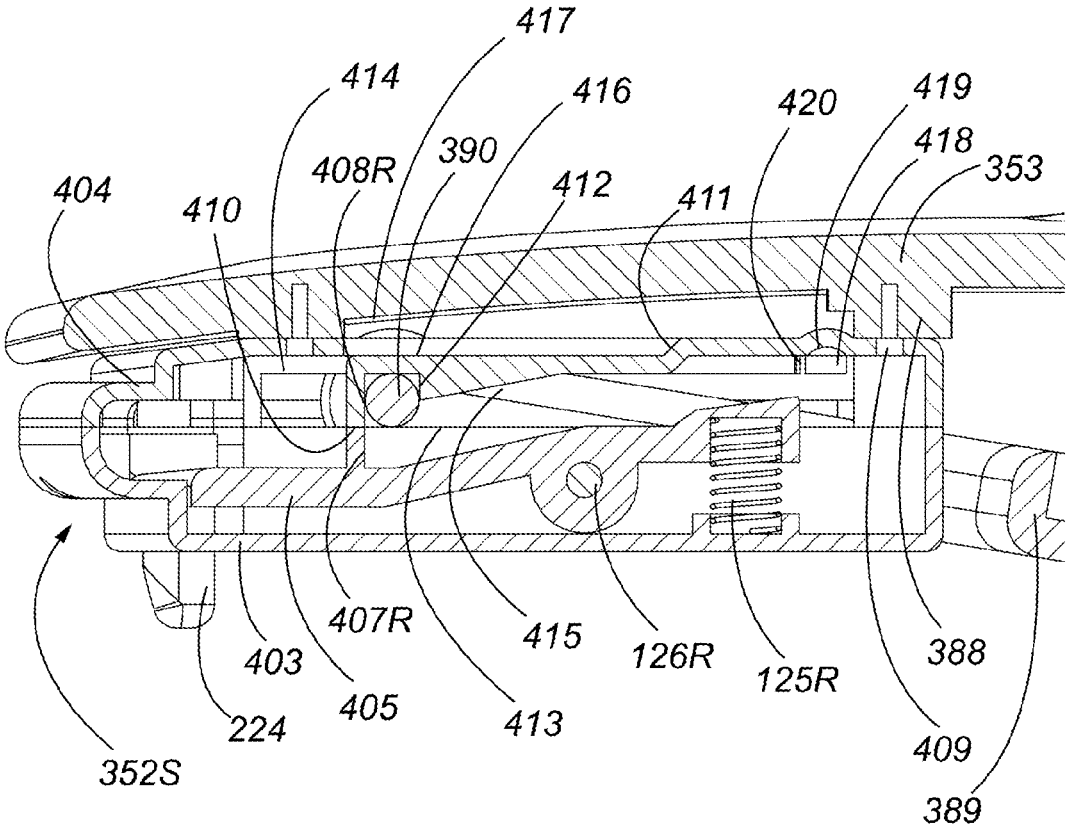
FIG. 12B is a section view of an assembled embodiment of a folding chair such as that shown in FIG. 3A illustrating a locked position of a pivot latch within a pivot cover subassembly.

FIG. 12B is a section view of the pivot cover subassembly 352S attached to the seat 353 with the angle stop subassembly 350S and the folding chair 100 in the folded locked position. When the chair is in a folded closed position, the rod 390 attached to the angle part 389 of the angle stop subassembly 350S is trapped in position by the downward extension of the cantilever beam 408R, a rear rib surface 412 of the cantilever beam 408R, an upper control surface 414 of the control enclosure part 404, and a lower control surface 413 of the pivot cover 403. In this position, the chair 100 is effectively locked. To open the chair 100, the central handle 224 is pressed, which causes the upward extension 407R of the pivot bar 405 to move upward and cause the corresponding cantilever beam 408R to bend upward. When the rib 412 of the cantilever beam 408R moves up far enough, the rod 390 is free to move rearward and the chair can be opened.

A contact surface 410 between the pivot bar extension 407R and the downward extension of the cantilever arm 408R can be adjusted to control the amount of pressure needed to free the rod 390 and thus the effort needed to open the chair. In addition, the geometry of a junction 411 of the cantilever beam 408R to the control enclosure part 404 can be adjusted to control the relative stiffness of the arm and the effort needed to deflect it. In another embodiment, the cantilever beam 408R, which can be molded in, can be replaced with one or more separate attached parts that have a spring behavior to accomplish the locking function.

During opening of the chair 100, the freed rod 390 of the angle stop subassembly 350S travels rearward between upper control surfaces 414 of the control enclosure part 404 and lower control surface 413 of the cover 403 until it once again becomes trapped by the geometry at the rear as shown in FIG. 12. This action effectively locks the chair in the open position as described previously.

When weight is then applied to the seat 353, the cantilever springs 418L, 418R bend upward from pressure of the rod 390 until the rod 390 rests against an upper pocket surface 419 of the track pockets 421L, 421R. In this position, vertical walls 420L, 420R block the forward motion of the rod 390 so that, even if the central handle 224 is depressed, the chair 100 is less likely to fold inadvertently.

As the person gets up and weight is removed from the seat 353, the cantilever springs 418L, 418R apply downward pressure to the rod 390 to return it to the track generally defined by the control surfaces 413, 414. When the cantilever springs 418L, 418R are compressed by the rod 390, the maximum opening position of the chair is decreased slightly. To compensate, the angular travel of the rear leg, front leg and back subassemblies may be increased slightly to substantially maintain the desired stance of the chair 100.

When the rod 390 of angle stop assembly 350S or pin 121R of the angle stop assembly 118S is released again as in FIG. 12A during closure of the chair 100, the rod 390 is free to travel forward. When moving forward, the rod 390 encounters a ramp 415 of the cantilever beam 408R that causes the beam 408R to bend upward. The beam 408R can bend upward until it contacts an underside surface 417 of the seat. But just prior to this maximum deflection, the rod 390 passes forward of the lower edge of the rib surface 412. The arm 408R will then snap downward trapping the rod 390, effectively locking the chair 100 again in the closed folded position.

Figure 13:
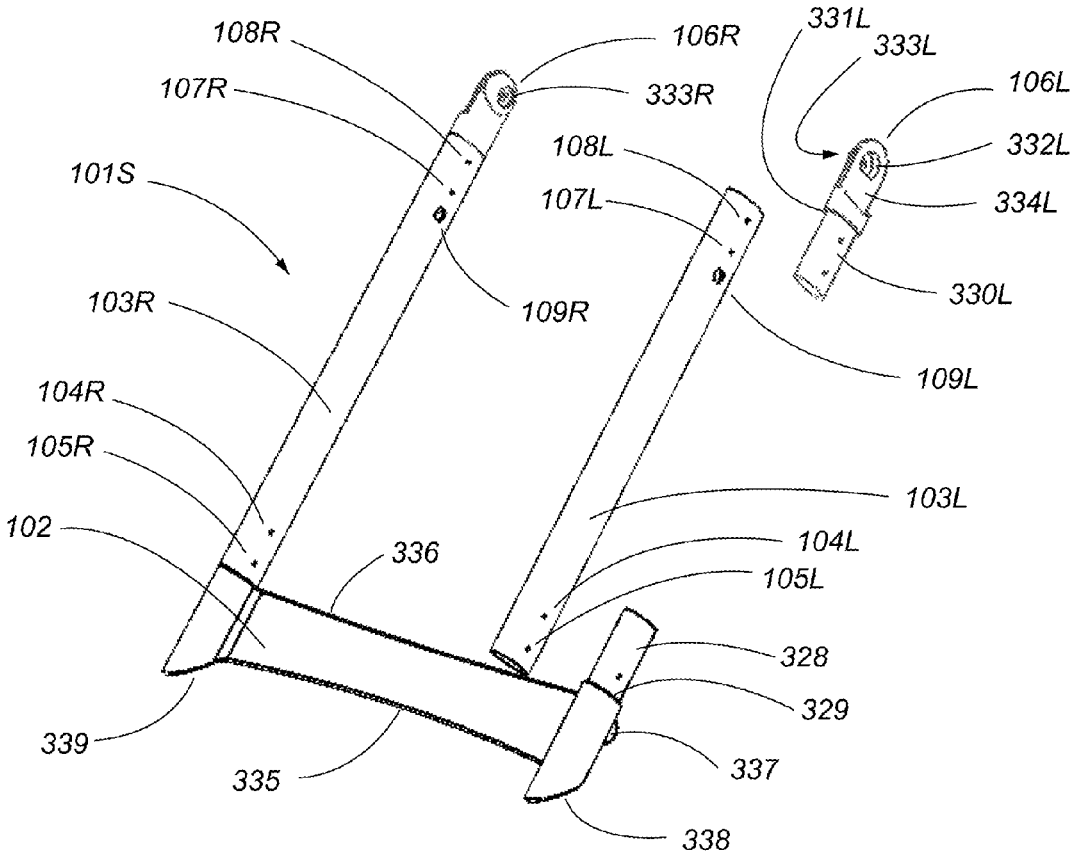
FIG. 13 is an exploded view of the front leg subassembly of FIG. 5.

FIG. 13 is an exploded view showing the construction technique employed in the front leg subassembly 101S described earlier. Additional detail shown here is the front stringer 102 connection to the left post 103L utilizing an integral shaft 328, which can be molded. In a similar manner, the joint 106L has a mating shaft 330L, which can be molded. In this embodiment, both shafts have an elliptical cross section that fits into a mating elliptical section of the extruded post 103L.

The front stringer 102 preferably has a curved back profile 335 for greater front foot clearance. A top curve height 336 preferably drops down in the center to allow foot and shoe heels to be pulled back during seating. The curved back profile 335 is reinforced at the rear with a rail extension 337 molded into the illustrated front stringer 102. The shaft 328 has a stop ridge 329 that correctly orients the post 103L as it slides onto the shaft 328. In a similar manner, the joint 106L preferably has a stop ridge 331 that correctly orients the post 103L as it slides onto the shaft 330L.

The joint 106L preferably has a recessed surface 334L that has a curved edge in clearance with the mating surface of the left gear box subassembly 168S. A further recess socket 332L fits over the mating shaft of 2.0L gear/axle 150. The opposite side of recess socket 332L has another recess 333L used for a washer and connecting bolt. This recess is more clearly depicted on that joint 106R as the recess 333R.

As described earlier, the joint 106L and the front stringer 102 are connected to the extruded post 103L with rivets or fasteners, for example. In some embodiments, the integral shaft 330L of the joint 106L and the integral shaft 328 of the front stringer 102 may be constructed with a tighter fit and employ a snap detail that would securely position within a respective slot within the extruded post 103L. Such a construction might be appropriate if the joint 106L were to become part of the gearbox subassembly 168S for assembly efficiency, for example. In a similar fashion, the snap detail attachment method could be employed in rear leg subassembly and back subassembly described below.

Figure 14:
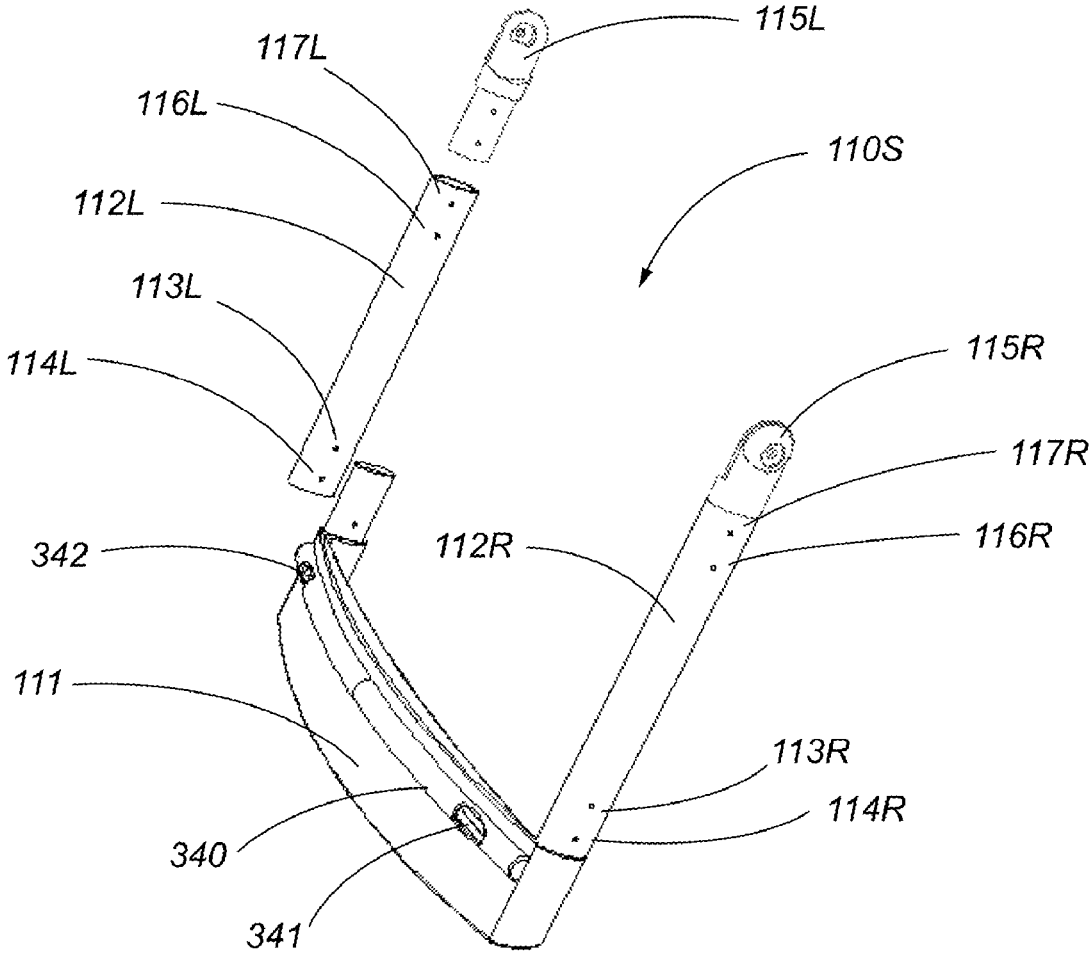
FIG. 14 is an exploded view of the rear leg subassembly of FIG. 5.

FIG. 14 illustrates an exploded view of the rear leg subassembly 110S. The assembly technique and details are similar to those used in the front leg subassembly 101S. The rear stringer 111 curves back from the rear edge of the posts 112R, 112L to reduce the likelihood of interference in the closed state with the front leg subassembly 101S stringer 102. The rear stringer 111 can be reinforced with a rail extension 340, which can be molded near the upper edge at the rear. The illustrated rail extension 340 comprises two pass-through slots 341, 342 that are used with a security cable to string together multiple chairs in larger gatherings.

Figure 15:
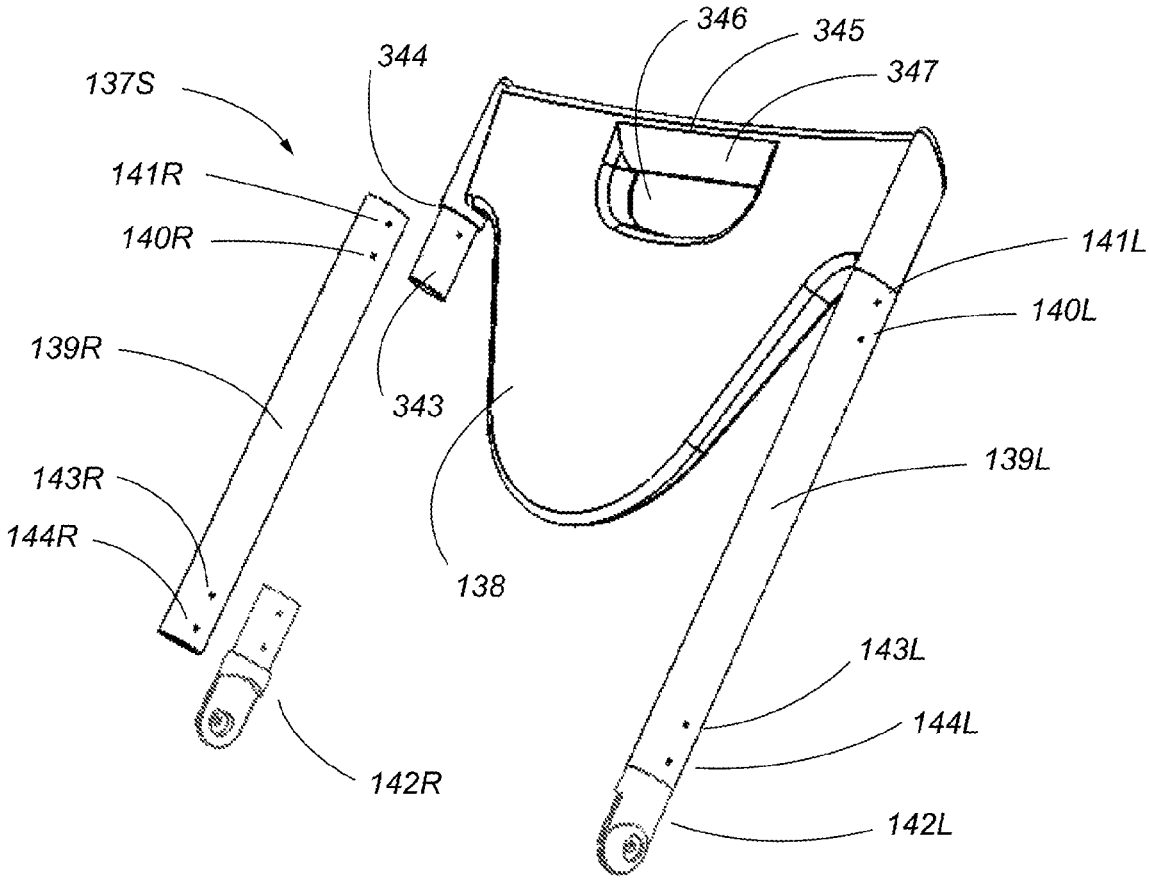
FIG. 15 is an exploded view of the back subassembly of FIG. 5.

FIG. 15 illustrates an exploded view of the back subassembly 137S. The assembly technique and details are similar to those used in the front leg subassembly 101S and the rear leg subassembly 110S. The back 138 preferably comprises a handle 345 integrally molded with a hand clearance slot 346. The handle 345 can comprise a carved back contour profile 347 that forms a half circle section. When two folded chairs are placed back to back the handle profiles are adjacent and form a complete circle section that can be carried as a single handle. This enables two folded chairs to be carried in one hand.

In some embodiments, the shaft 343 of the back 138 can comprise a single hole that mates with the hole 141R of the right post 139R and that accepts a pin connector. The shaft 343 cross-section can be contoured for a snug fit with the right post 139R, the stop ridge 344 can establish position, and the pin can be used to retain position. In some embodiments, the shaft 343 has a clearance fit with the right post 139R and two pins or rivets are used, for example. One pin can mate with the hole 141R to retain position, while the second pin can mate with the hole 140R to reduce the likelihood of off centerline orientation. In such an embodiment, the stop ridge 344 would not be available to establish position.

Figure 16:
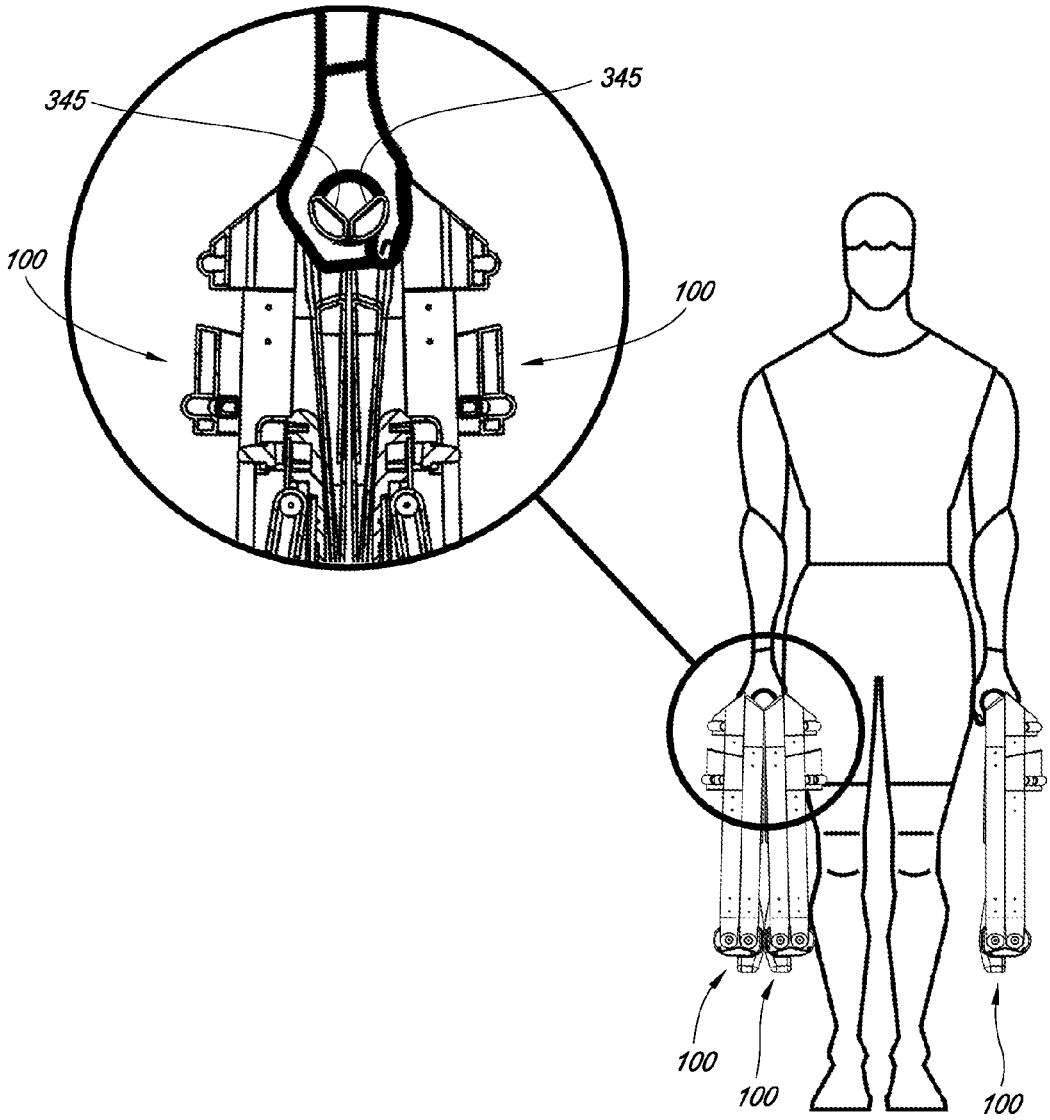
FIG. 16 is a view of a person holding three chairs.

FIG. 16 illustrates a detail and a section view of a 50 percentile (approximately 68.8" tall) U.S. male carrying two folded chairs 100 in his right hand and one folded chair 100 in his left hand. In some preferred embodiments, the integral handle 345 of the backrest 138 is contoured as described above such that when two chairs are carried back-to-back the carved back contour profile forms a circle section that is carried as a single handle. Carrying two chairs in one hand is suitable for adults of average height (50 percentile) and grip size. In an alternate embodiment, the contour profile 347 of the integral handle 345 is adjusted to fit smaller grip sizes.

It can be appreciated that the overall length of the folded chair 100 in the folded position can be compact such that it is possible for a child of 9 years of age (approximately 53" tall) to carry the chair in one hand with the arm fully extended in the downward relaxed position. In chairs of length exceeding 23" the child would have to raise the arm to avoid dragging the chair and fatigue sets in quickly.

The overall chair 100 width can be determined primarily by the gearbox housings 145S, 168S, and also by the front and rear stringers 102, 111. In some embodiments, the width can be reduced by decreasing the gear diameters (but not the gear ratios) of the geartrains and the enclosing housings. The front leg, rear leg and back subassembly components can then be reduced in width. Also, in some embodiments, the front and rear stringers 102, 111 are made flat and so the effective overall chair width is driven only by the gear housings. Such configurations can be especially desirable to minimize arm flare-out when carrying two chairs in one hand.

Although certain features, aspects and advantages of the present invention have been disclosed in the context of certain preferred embodiments, examples and variations, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is specifically contemplated that various combinations or subcombinations of the specific features and aspects of the embodiments may be made and still fall within the scope of the invention. It should be understood that various features and aspects of the disclosed embodiments can be combined with or substituted for one another in order to form varying modes of the disclosed invention. Moreover, some variations that have been described with respect to one embodiment and not another embodiment can be used with such other embodiments. Many other variations also have been described herein and cross-application is intended where physically possible. Thus, it is intended that the scope of the present invention herein disclosed should not be limited by the particular disclosed embodiments described above, but should be determined only by a fair reading of the claims that follow.

What is claimed is:

1. A folding chair that uses a gear train to control a folding motion, the folding chair comprising:

a seat;

a right gearbox and a left gearbox mounted to the seat;

a front leg subassembly movably attached to the right and left gearboxes;

a rear leg subassembly movably attached to the right and left gearboxes; and a back subassembly movably attached to the right and left gearboxes.

2. The folding chair of claim 1 further comprising a brace that is attached between the seat and the front leg subassembly.

3. The folding chair of claim 2, wherein the brace comprises an angle stop subassembly that supports the seat in an open position.

4. The folding chair of claim 3 further comprising a position controller that is attached to a bottom of the seat and that is adapted to secure and control the angle stop subassembly.

5. The folding chair of claim 4, wherein the position controller comprises a pivot cover subassembly.

6. The folding chair of claim 1 further comprising a cross brace that attaches to the gear boxes that stabilizes the front leg, rear leg, and back subassemblies.

7. The folding chair of claim 6, wherein the cross brace mounts the left and right gear boxes to the seat.

8. The folding chair of claim 1, wherein the rear legs comprise a length and the folding chair folds compactly into a length not longer than the length of the rear legs.

9. The folding chair of claim 1, wherein the right and left gear boxes each comprises a housing, a right gear train being positioned within the right housing and a left gear train being positioned within the left housing.

10. The folding chair of claim 9, wherein the gear boxes each comprise gear trains that use a 1:2 ratio to control open/collapse operation.

11. The folding chair of claim 9, wherein the gear teeth within the gear boxes have an alignment pattern relative to a respective gear hub cutoff surface and so that the left and right gears are not interchangeable.

12. The folding chair of claim 11, wherein the right gear box components are identified with a unique orientation marking molded into the parts that distinguishes the components from those of the left gear box.

13. The folding chair of claim 9, wherein the right and left gearboxes are connected by a cross brace.

14. The folding chair of claim 13, wherein the cross brace is attached to the seat.

15. The folding chair of claim 1, wherein the front leg subassembly attaches to the right and left gear boxes with a self-aligning joint and at least one screw.

16. The folding chair of claim 1, wherein the rear leg subassembly attaches to the right and left gear boxes by a self-aligning joint and at least one screw.

17. The folding chair of claim 1, wherein the back subassembly attaches to the right and left gearboxes by a self-aligning joint and at least one screw.

18. The folding chair of claim 17, wherein the self-aligning joint is a common part shared by the front leg, rear leg, and back subassemblies.

19. The folding chair of claim 1, wherein the front and rear leg subassemblies comprise molded stringers with integral connecting shafts that define continuous flush surfaces between mating posts and stringers.

20. The folding chair of claim 19, wherein the molded stringers with integral shafts connect to the posts with a pin or rivet that is aligned by an integral stop ridge.

21. The folding chair of claim 1, wherein the back subassembly uses a molded back with integral connecting shafts that define continuous flush surfaces between mating posts and the molded back.

22. The folding chair of claim 21, wherein the molded back with integral shafts connects to the posts with a pin or rivet that is aligned by an integral stop ridge.

23. The folding chair of claim 1, wherein the front leg subassembly comprises a stringer that has a laid back angle configuration.

24. The folding chair of claim 1, wherein the rear leg subassembly comprises a stringer having an integral cable pass through holes for securing rows of chairs.

25. The folding chair of claim 1, wherein a brace attaches between the seat and posts of the front leg subassembly, the brace pivoting on pins such that it can compactly fold within the front leg width.

26. The folding chair of claim 25, wherein the brace comprises an angle stop subassembly.

27. The folding chair of claim 26, wherein the angle stop subassembly comprises an angle stop and the angle stop comprises one or more stiffening ribs.

28. The folding chair of claim 25, wherein the pins ride along an under surface of the seat and are contained by a pivot cover.

29. The folding chair of claim 28, wherein the ramp surface is part of a pivot arm that utilizes spring pressure to maintain a locked position.

30. The folding chair of claim 29, wherein the pivot arm features a central handle that is adapted to be depressed to release the locked pins and allow the chair to fold.

31. The folding chair of claim 28, wherein the ramp surface is depressed by the pins during opening of the chair until reaching a vertical wall and locked position.

32. The folding chair of claim 31, wherein the locked position of the chair is achieved automatically during opening without further effort by the user.

33. The folding chair of claim 28, wherein the pins are locked in position by another surface when the chair is in the folded closed position.

34. The folding chair of claim 33, wherein the surface is a ramp surface of a cantilever beam.

35. The folding chair of claim 34, wherein an extension of a pivot arm contacts the cantilever arm such that the cantilever arm is deflected away from the locked pins, which allows the chair to unfold.

36. The folding chair of claim 34, wherein the ramp surface is depressed by the pins during folding of the chair until the pin reaches at least one of a vertical wall and a locked position.

37. The folding chair of claim 36, wherein the locked position is achieved automatically during folding of the chair without further effort by the user.

38. The folding chair of claim 25, wherein the pins are locked in position by a ramp surface in the open position.

39. The folding chair of claim 1, wherein the back subassembly comprises an integral handle, the handle adapted to be grasped by one hand supporting the chair as it unfolds by gravity force into a locked open position.

40. The folding chair of claim 39, wherein the integral handle is contoured such that the user can hold two chairs in one hand back to back during transport with the arm fully extended in the downward relaxed position.

41. The folding chair of claim 1, wherein the back subassembly comprises a seat back and the seat back comprises one or more stiffening ribs.

42. The folding chair of claim 1, wherein the front leg subassembly comprises a stringer that connects a left post to a right post, the stringer comprising one or more stiffening rib.

43. The folding chair of claim 1, wherein the rear leg subassembly comprises a stringer that connects a left post to a right post, the stringer comprising one or more stiffening ribs.

44. The folding chair of claim 1, wherein at least one of the right and left gearboxes comprises a gear train of multiple gears, at least one of the multiple gears comprising a control surface that limits a rotational range of the at least one gear.

45. The folding chair of claim 1, wherein at least one of the right and left gearboxes comprises a gear with a first control surface and a second control surface, the first and second control surfaces limiting a range of rotation of the gear.

46. A folding chair comprising a seat, a gear box connected to the seat, the gear box having a first shaft connected to a first leg subassembly, the gear box having a second shaft connected to a second leg subassembly, the gear box having a third shaft connected to a seat back subassembly, and the first shaft, the second shaft and the third shaft being connected by a gear combination.

* * * * *